US006947699B2

(12) United States Patent
Suzuki et al.

(10) Patent No.: US 6,947,699 B2
(45) Date of Patent: Sep. 20, 2005

(54) IMAGE HEATING APPARATUS WITH PROJECTION EXTENDING IN LONGITUDINAL DIRECTION OF SUPPORTING MEMBER

(75) Inventors: Masahiro Suzuki, Numazu (JP); Akihiko Takeuchi, Susono (JP); Toshiaki Miyashiro, Shizuoka-ken (JP); Atsuyoshi Abe, Susono (JP); Takaaki Tsuruya, Mishima (JP); Tomonori Shida, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/358,177

(22) Filed: Feb. 5, 2003

(65) Prior Publication Data

US 2003/0170054 A1 Sep. 11, 2003

(30) Foreign Application Priority Data

Feb. 5, 2002 (JP) ..... 2002/027970
Mar. 27, 2002 (JP) ..... 2002/087772

(51) Int. Cl.[7] ..... G03G 15/20
(52) U.S. Cl. ..... 399/329; 219/216
(58) Field of Search ..... 399/324, 329, 399/328; 219/216

(56) References Cited

U.S. PATENT DOCUMENTS

| | | | | |
|---|---|---|---|---|
| 4,970,219 A | | 11/1990 | Effland et al. | 514/339 |
| 5,149,941 A | | 9/1992 | Hirabayashi et al. | 219/216 |
| 5,210,579 A | | 5/1993 | Setoriyama et al. | |
| 5,267,005 A | * | 11/1993 | Yamamoto et al. | 399/329 |
| 5,319,425 A | * | 6/1994 | Forlani | 399/328 |
| 5,525,775 A | * | 6/1996 | Setoriyama et al. | 219/216 |
| 5,534,987 A | | 7/1996 | Ohtsuka et al. | |
| 5,543,904 A | | 8/1996 | Kato et al. | |
| 5,552,582 A | | 9/1996 | Abe et al. | 219/619 |
| 5,552,874 A | | 9/1996 | Ohtsuka et al. | |
| 5,568,240 A | | 10/1996 | Ohtsuka | |
| 5,745,833 A | | 4/1998 | Abe et al. | 399/330 |
| 5,819,150 A | | 10/1998 | Hayasaki et al. | 399/330 |
| 5,852,763 A | | 12/1998 | Okuda et al. | 399/329 |
| 5,874,710 A | * | 2/1999 | Yoshimoto et al. | 219/216 |
| 5,881,349 A | | 3/1999 | Nantaki et al. | 399/328 |
| 5,940,655 A | | 8/1999 | Sano et al. | 399/69 |
| 5,966,577 A | | 10/1999 | Abe | 399/320 |
| 5,970,299 A | | 10/1999 | Sano et al. | 399/330 |

(Continued)

FOREIGN PATENT DOCUMENTS

| | | | | |
|---|---|---|---|---|
| JP | 63-313182 | | 12/1988 | |
| JP | 02-157878 | | 6/1990 | |
| JP | 4-44075 | | 2/1992 | |
| JP | 04-204980 | | 7/1992 | |
| JP | 05-027619 | | 2/1993 | |
| JP | 7-114276 | | 5/1995 | |
| JP | 10198200 A | * | 7/1998 | G03G/15/20 |

*Primary Examiner*—Robert Beatty
(74) *Attorney, Agent, or Firm*—Fitzpatrick, Cella, Harper & Scinto

(57) ABSTRACT

An image heating apparatus for heating an image formed on a recording material includes a flexible movable member: a supporting member, having a sliding surface for sliding relative to the movable member, for supporting the movable member; a pressing member for forming a nip with the supporting member with the movable member therebetween; wherein the supporting member is provided adjacent the sliding surface with a projection which is projected toward the pressing member beyond the sliding surface, the projection being extended in a longitudinal direction of the supporting member, and wherein the supporting member is provided at a longitudinal end portion with a cut-away portion providing a projection height which is smaller than that of the projection or providing a portion substantially flush with the sliding surface.

24 Claims, 15 Drawing Sheets

U.S. PATENT DOCUMENTS

| | | | | |
|---|---|---|---|---|
| 6,031,215 | A | 2/2000 | Nanataki et al. | 219/619 |
| 6,049,691 | A | 4/2000 | Abe et al. | 399/330 |
| 6,078,780 | A | 6/2000 | Abe et al. | 399/328 |
| 6,097,919 | A | 8/2000 | Takeuchi et al. | 399/298 |
| 6,263,172 | B1 | 7/2001 | Suzuki et al. | 399/67 |
| 6,383,628 | B2 | 5/2002 | Abe et al. | 428/334 |
| 6,456,819 | B1 | 9/2002 | Abe et al. | 399/329 |
| 6,459,877 | B1 * | 10/2002 | Yoda et al. | 399/325 |
| 6,505,027 | B2 | 1/2003 | Takeuchi et al. | 399/328 |
| 2002/0023920 | A1 | 2/2002 | Abe et al. | 219/619 |
| 2002/0044802 | A1 | 4/2002 | Tsuruya et al. | 399/322 |
| 2002/0108947 | A1 | 8/2002 | Tsuruya et al. | 219/619 |
| 2002/0146259 | A1 | 10/2002 | Zhou et al. | 399/329 |

* cited by examiner

IMAGE HEATING APPARATUS WITH PROJECTION EXTENDING IN LONGITUDINAL DIRECTION OF SUPPORTING MEMBER

FIELD OF THE INVENTION AND RELATED ART

The present invention relates to an image heating apparatus preferable as a thermal heating apparatus for an image forming apparatus employing an electrophotographic, electrostatic recording method, or the like method. In particular, it relates to an image heating apparatus employing a flexible movable member, for example, a sleeve formed of film, as a member which contacts recording medium.

In an image forming apparatus employing an image processing means such as an electrophotographic recording means, an electrostatic recording means, a magnetic recording means, or the like, an unfixed image (toner image) is directly (direct method), or indirectly (transfer method), formed on a piece of recording medium (transfer sheet, electro-fax sheet, electrostatic recording sheet, OHP sheet, printing paper, formatted sheet, etc.) according to the image formation information, by the processing means. Then, the unfixed image is thermally fixed to the recording surface of the recording medium; it is turned into a permanent image. Among various types of fixing apparatuses, heat roller type fixing apparatuses have been widely used.

In recent years, from the standpoint of quick start and energy conservation, so-called film heating type fixing methods have been put to practical use. Further, fixing apparatuses employing an electromagnetic heating method have been proposed.

a) Film Heating method

Fixing apparatuses (fixing devices) employing the film heating method are proposed in Japanese Laid-open Patent Applications 63-313182, 2-157818, 4-44075, 4-204980, etc.

According to these applications, the fixing apparatus comprises a ceramic heater as a heating member, a pressure roller as a pressing member, a piece of heat resistant file (fixing film belt). The heat resistant film is sandwiched between the ceramic heater and pressure roller, forming a fixing nip. In operation, a recording medium bearing an unfixed toner image is fed into the fixing nip, between the fixing film and pressure roller, and conveyed through the fixing nip, along with the fixing film, being pressed upon the ceramic heater by the pressure roller. While the recording medium is conveyed through the fixing nip, the heat from the ceramic heater is given to the recording medium through the fixing film. As a result, the unfixed toner image is fixed to the surface of the recording medium.

With the employment of a combination of a ceramic heater with a low thermal capacity and a fixing film with a low thermal capacity, this film heating type fixing apparatus can be realized as an on-demand type fixing apparatus. More specifically, the temperature of a ceramic heater as a heat source has to be at the image fixing level only during the period in which an image is actually fixed. A film heating type fixing apparatus employing the combination of a ceramic heater with a low thermal capacity and a fixing film with a low thermal capacity enjoys a few advantages. For example, it is shorter in the time from the moment the power of an image forming apparatus is turned on to when the image forming apparatus becomes ready for an image forming process proper (being capable of quickly starting up), and uses a substantially smaller amount of power while it is on standby (being superior in terms of power conservation).

b) Film Heating Method based on Electromagnetic Induction

Japanese Laid-open Patent Application 7-114276 proposes a film heating type image heating apparatus, which comprises a fixing film and an electrically conductive member disposed close to the fixing film. In operation, eddy current is generated in the electrically conductive member to generate heat (Joule heat) in the film itself; in other words, heat is generated by electromagnetic induction. This film heating method based on electromagnetic induction makes it possible to place the heat generating portion of the fixing apparatus close to an object to be heated, being therefore superior to a film heating method employing a ceramic heater, in terms of thermal efficiency.

In a fixing apparatus employing a film heating type method inclusive of a film heating type method based on electromagnetic induction, an endless film in the form of a cylinder or the like is rotationally driven. As for the method for driving the endless fixing film, various methods are available. One of such methods is a pressure roller driving method. According to this method, a fixing film is sandwiched between a film guiding member (film supporting member), and a pressure roller. The film guiding member guides the fixing film by being placed in contact with the inward surface of the fixing film, In operation, the pressure roller is driven so that the fixing film is rotated by the rotation of the pressure roller. According to another method for driving the endless fixing film, an endless fixing film is suspended around a driving roller, a tension roller, a pressure roller, etc., and the pressure roller is rotated by the rotation of the fixing film.

The torque necessary to rotate a fixing film is affected by the friction between the fixing film and a film guiding member. Therefore, in order to reduce the friction between the fixing film and film guiding member, various measures are taken, for example, lubricant such as heat resistant grease is placed between the inward surface of the fixing film and the film guiding member. According to Japanese Laid-open Patent Application 5-27619 regarding a film heating method, lubricant (grease) is placed between a fixing film and a film guide to ensure that the fixing film easily slides on the film guide.

One of the problems of a conventional film heating type fixing apparatus is that a conventional film heating type fixing apparatus is likely to suffer from the so-called wrap-around paper jam, that is, a problematic phenomenon that a recording medium wraps around the fixing film. This wrap-around paper jam is likely to occur, in particular, while a full-color image, which is greater in the amount of toner on the recording medium, is fixed, and when an image is fixed to thin paper, or wet paper, which is relatively low in resiliency.

In order to prevent a wraparound paper jam, it is necessary to make it easier for a recording medium to separate from a fixing film after the passage of a recording medium through the fixing nip. One of the methods for making it easier for a recording medium to separate from a fixing film is to provide the downstream end, with respect to the film sliding portion of the film supporting member, of a film supporting member with a ridge which protrudes toward a pressure roller from the film sliding surface of the film supporting member. With the provision of this ridge, a recording medium is nudged in the direction in which the recording medium is to separate from the fixing film due to the curvature of the fixing film, assuring the separation of the recording medium from the fixing film.

However, the provision of a ridge such as the above described one resulted in the following problems. That is, the grease on the inward surface of the fixing film was scraped away by the ridge, collecting on the upstream side of the ridge, in terms of the direction in which the fixing film moves, and oozing from the lateral edges of the fixing film. Further, the loss or reduction of the grease from the inward surface of the fixing film resulted in the increase in the friction between the fixing film and film supporting member, which sometimes caused slip between the fixing film and pressure roller, or between the fixing film and recording medium. This slip sometimes resulted in a paper jam, image defects, etc. The increase in the friction between the fixing film and fixing film supporting member increased the torque necessary to drive the fixing device, putting the fixing apparatus driving motor out of synchronism. Further, the increase in the friction caused the fixing film to repeatedly stop and move with short intervals, generating the so-called "stick-and-slip noises", which were more apparent when the fixing film and film supporting member were less-compatible in terms of friction.

SUMMARY OF THE INVENTION

The present invention was made in view of the above described problems, and its primary object is to provide an image heating apparatus in which an object to be heated is allowed to easily separate from the heating member, and which is low in the torque necessary to drive the image heating apparatus.

Another object of the present invention is to provide an image heating apparatus which enhances the effectiveness of the lubricant for reducing the torque necessary to drive the image heating apparatus.

Another object of the present invention is to provide an image heating apparatus comprising: flexible movable member; supporting member having a surface on which the movable member slides, and which supports the movable member; a pressing member kept pressed upon the supporting member to form a nipping portion, with the movable member sandwiched between the pressing member and supporting member; wherein the supporting member is provided with a ridge, which is disposed close to the fixing film sliding (supporting) portion of the surface of the supporting member, extending in the lengthwise direction of the supporting member, and which projects toward the pressing member from the fixing film sliding surface; and wherein the lengthwise end portions of the ridge do not protrude as high as the portion between the lengthwise end portions, from the film sliding surface of the supporting member, or are level with the fixing sliding surface of the supporting member.

Another object of the present invention is to provide an image heating apparatus comprising: a flexible movable member; a supporting member having a surface on which the movable member slides, and which supports the movable member; a pressing member kept pressed upon the supporting member to form a nipping portion, with the movable member sandwiched between the pressing member and supporting member; wherein the supporting member is provided with a ridge, which is disposed close to the fixing film sliding (supporting) portion of the surface of the supporting member, extending in the lengthwise direction of the supporting member, and which projects toward the pressing member from the fixing film sliding surface; and wherein the ridge has one or more slits.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1

(1) Typical Image Forming Apparatus

Figure 19:
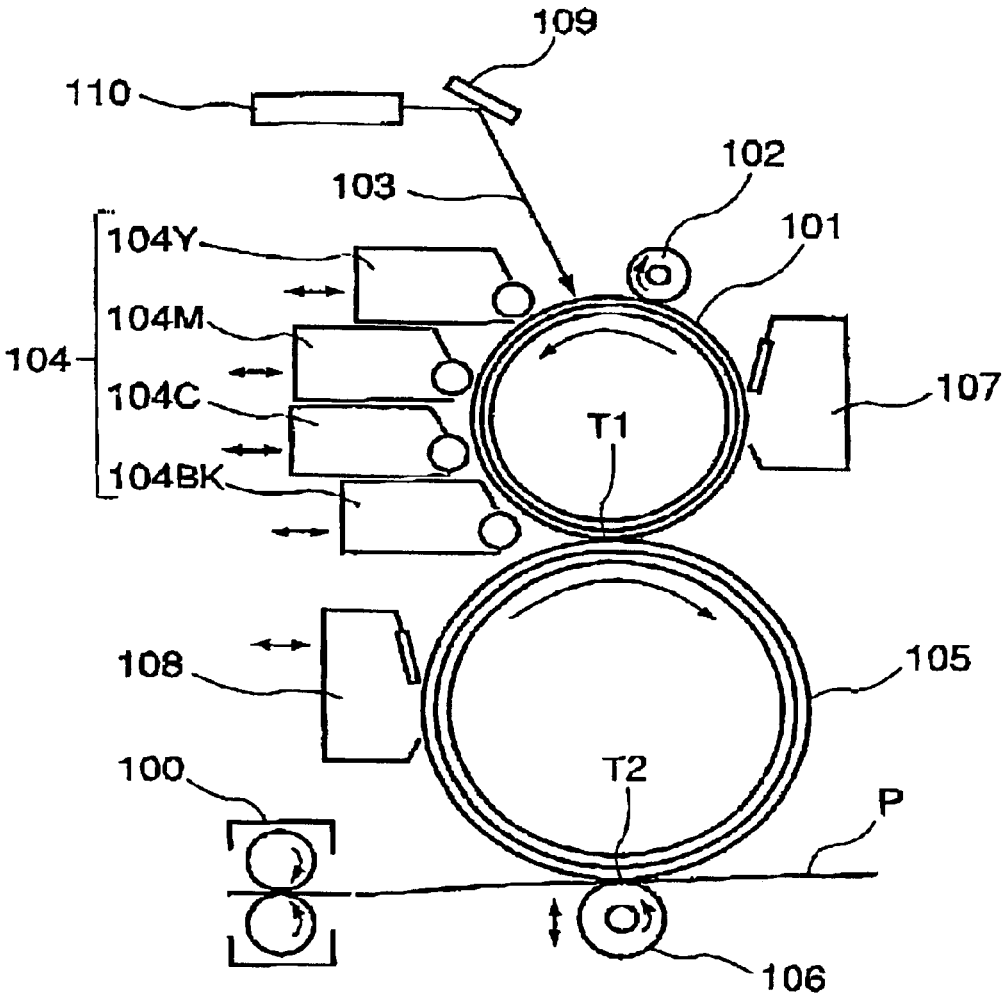
FIG. 19 is a schematic sectional view of an image forming apparatus having an image heating apparatus in accordance with the present invention.

FIG. 19 is a drawing of a typical image forming apparatus, for showing the general structure thereof. This image forming apparatus is a color laser printer employing an electrophotographic process.

This image forming apparatus has a photoconductive drum 101 as an latent image bearing member, which comprises a layer of organic photoconductor, amorphous silicon, or the like, and which is rotationally driven in the counterclockwise direction indicated by an arrow mark, at a predetermined conveyance speed (peripheral velocity). While the photoconductive drum 101 is rotated, it is uniformly charged by a charging apparatus 102 comprising a charging roller or the like, to predetermined polarity and potential level.

The charged surface of the photoconductive drum 101 is exposed to a beam L of laser light outputted in a scanning manner from an optical box (laser scanner) 110. More specifically, the peripheral surface of the photoconductive drum 101 is scanned by the laser beam 103 outputted from the optical box 110 while being modulated (turned on and off) with sequential electric signals in accordance with the image formation information regarding an intended image sent from an unshown image formation signal generating apparatus such as an image reading apparatus. As a result, an electrostatic latent image in accordance with the image formation information of the intended image is formed on the peripheral surface of the photoconductive drum 101. After being outputted from the optical box 110, the beam of laser light is deflected by a mirror 109 toward the peripheral surface of the photoconductive drum 101.

When forming a full-color image, four images corresponding to the four primary color components, into which a full-color image is separated, are consecutively formed. More specifically, first, the latent image corresponding to, for example, yellow color component, that is, one of the color components making up the intended full-color image, is formed, and this latent image is developed into a yellow toner image by a yellow component developing device 104*y*, that is, one of the four color component developing devices. The yellow toner image is transferred onto the peripheral surface of an intermediary transfer drum 105, in a primary transfer station T1, which is the interface between the photoconductive drum 101 and intermediary transfer drum 105 (or area in which two drums virtually contact each other). After the transfer of the toner image onto the peripheral surface of the photoconductive drum 101, the peripheral surface of the photoconductive drum 101 is cleared of residues, for example, transfer residue, by a cleaner 107; the peripheral surface of the photoconductive drum 101 is cleaned by the cleaner 107.

The above described image formation cycle comprising the charging process, exposing process, developing process, transfer process, and cleaning process is sequentially carried out for the second (for example, magenta), third (for example, cyan), and fourth (for example, black) color components of the intended full-color image, using the magenta developing device 104M, cyan developing device 104C, and black developing device 104Bk, respectively. As a result, the yellow, magenta, cyan, and black toner images are sequentially placed in layers on the peripheral surface of the intermediary transfer drum 105, synthetically realizing a color toner image which reflects the intended full-color image.

The intermediary transfer drum 105 comprises a metallic drum, an elastic intermediary layer, and a surface layer. The elastic layer covers the peripheral surface of the metallic drum, and its electrical resistance is in the mid range. The surface layer covers the intermediary layer, and its electrical resistance is in the high range. The intermediary transfer drum 105 is disposed so that its peripheral surface is placed in contact with, or close to, the peripheral surface of the photoconductive drum 101, and is rotationally driven in the clockwise direction indicated by an arrow mark, at the same peripheral velocity as the photoconductive drum 101. To the metallic drum of the intermediary transfer drum 105, a predetermined voltage is applied so that the toner image on the peripheral surface of the photoconductive drum 101 is transferred onto the peripheral surface of the intermediary transfer drum 105 by the difference (bias) in potential level between the photoconductive drum 101 and intermediary transfer drum 105.

The color toner images formed on the peripheral surface of the intermediary transfer drum 105 are conveyed to the secondary transfer station T2, which is the contact nip between the intermediary transfer drum 105 and a transfer roller 106, in which the color toner images are transferred onto the surface of a recording medium P delivered to the secondary transfer station T2 from an unshown sheet feeding station. More specifically, the transfer roller 106 gives to the recording medium P, from behind the recording medium P, such electrical charge that is opposite in polarity to the toner. As a result, the four color toner images making up the synthetic full-color image on the peripheral surface of the intermediary transfer drum 105 are transferred all at once onto the recording medium P as if they were rolled out onto the recording medium P.

After passing through the secondary transfer station T2, the recording medium P is separated from the peripheral surface of the intermediary transfer drum 105, and is introduced into a fixing apparatus (image heating apparatus) 100 as a fixing means, in which the unfixed toner images are thermally fixed to the recording medium P, becoming parts of a permanent full-color image. Thereafter, the recording medium P is discharged into an unshown delivery tray located outside the main assembly of the image forming apparatus.

After the transfer of the color toner images onto the recording medium P, the intermediary transfer drum 105 is cleared of residues such as toner particles, paper dust, etc., adhering to the peripheral surface of the intermediary transfer drum 105, by a cleaner 108; it is cleaned by the cleaner 108. Normally, the cleaner 108 is not kept in contact with the intermediary transfer drum 105; it is kept in contact with the intermediary transfer drum 105 only during the secondary transfer of the color toner images from the intermediary transfer drum 105 onto the recording medium P.

Normally, the transfer roller 106 also is not kept in contact with the intermediary transfer drum 105; it is kept in contact with the intermediary transfer drum 105, with the interposition of recording medium P, only during the secondary transfer of the color toner images from the intermediary transfer drum 105 onto the recording medium P.

The image forming apparatus in this embodiment is capable of carrying out: a monochromatic print mode, that is, a printing mode in which a monochromatic image such as a black-and-white image is formed; a two-side printing mode; and a multilayer printing mode.

The two-sided printing mode is carried out as follows. After coming out of the fixing apparatus 100, bearing a permanent image on one of its recording surfaces, the recording medium P is put through an unshown recirculatory conveyance mechanism, being thereby placed upside down. Then, the recording medium P is sent again to the secondary transfer station T2, in which an image is transferred onto the second recording surface of the transfer medium P. Then, the transfer medium P is sent for the second time into the fixing apparatus 100, in which the toner image on the second recording surface of the transfer medium P is fixed. Then, the recording medium P is outputted as a two-sided print.

The multilayer printing mode is carried out as follows. After coming out of the fixing apparatus 100, bearing a permanent image on one of its recording surfaces, the recording medium P is sent again to the secondary transfer station T2, without being placed upside down by being put through an unshown recirculatory conveyance mechanism. Then, in the secondary transfer station T2, another toner image is transferred onto the very surface of the transfer medium P, onto which an image has been already transferred during the first run. Then, the recording medium P is sent for the second time into the fixing apparatus 100, in which the second toner image is fixed. Then, the recording medium P is outputted as a multilayer print.

(2) General Structure of Fixing Apparatus 100

The fixing apparatus 100, as an embodiment of an image heating apparatus in accordance with the present invention, employs a cylindrical fixing film (fixing belt) in which heat can be generated by electromagnetic induction. Further, it employs a pressure roller driving method, and a heating method based on electromagnetic induction.

Figure 1:
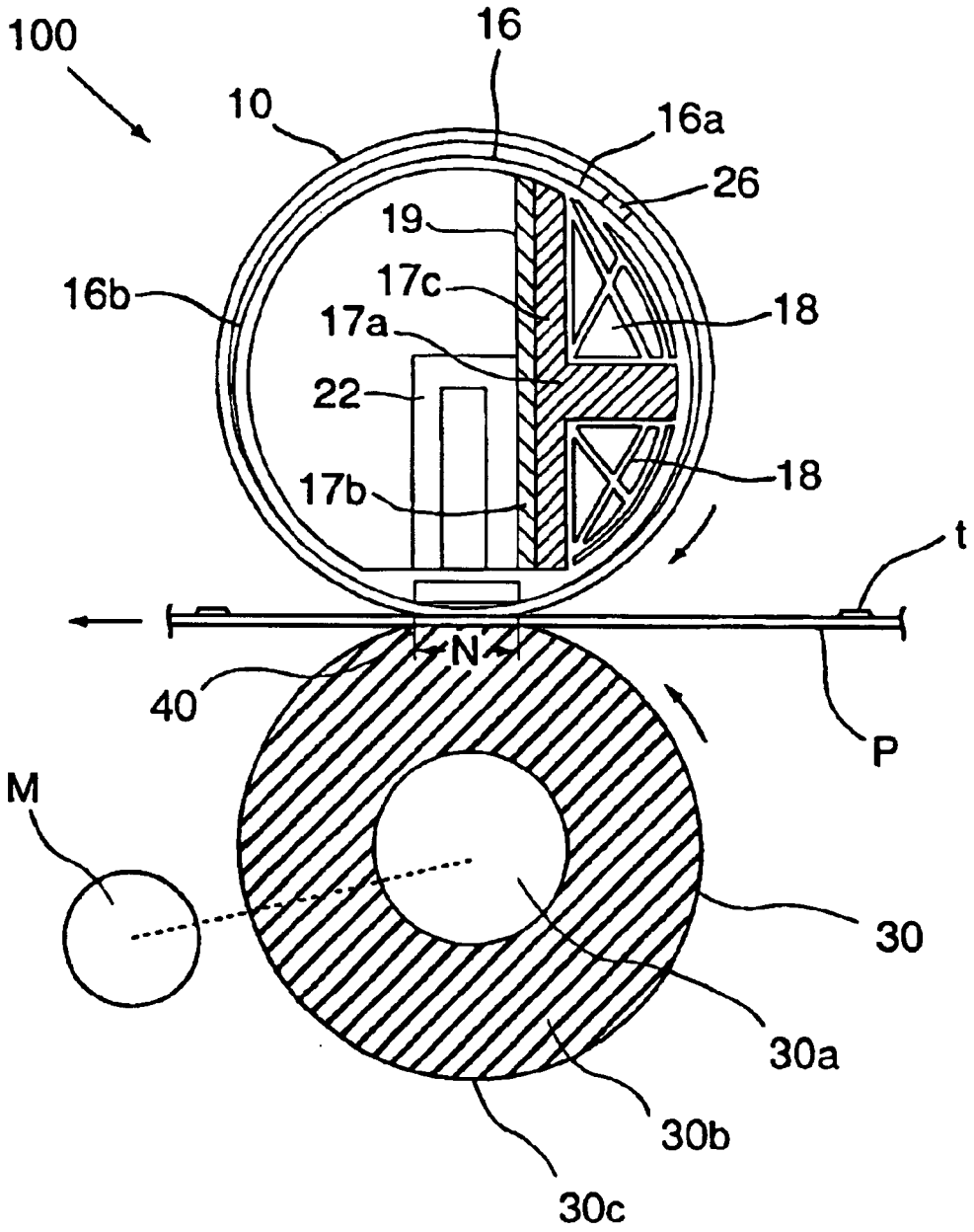
FIG. 1 is a schematic sectional view of the essential portions of the fixing apparatus in accordance with the present invention.
Figure 2:
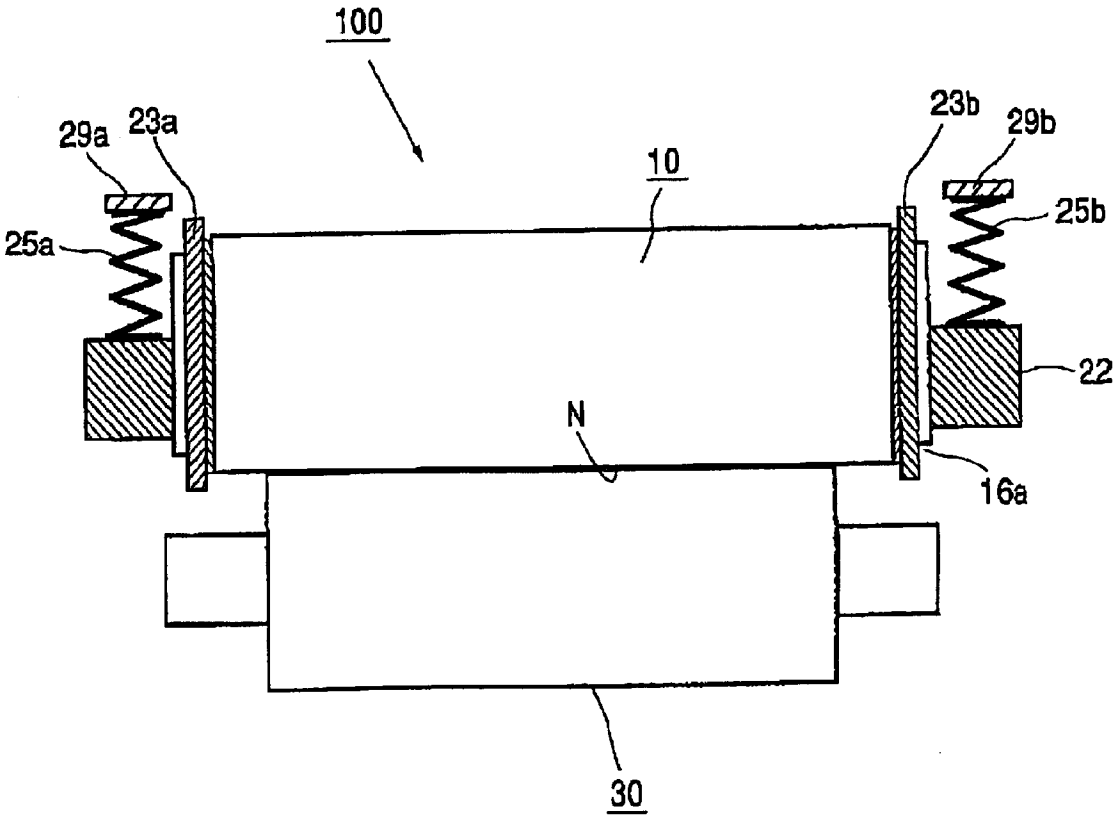
FIG. 2 is a schematic side view of the essential portions of the fixing apparatus in FIG. 1, as seen from the direction in which a recording medium is conveyed.
Figure 3:
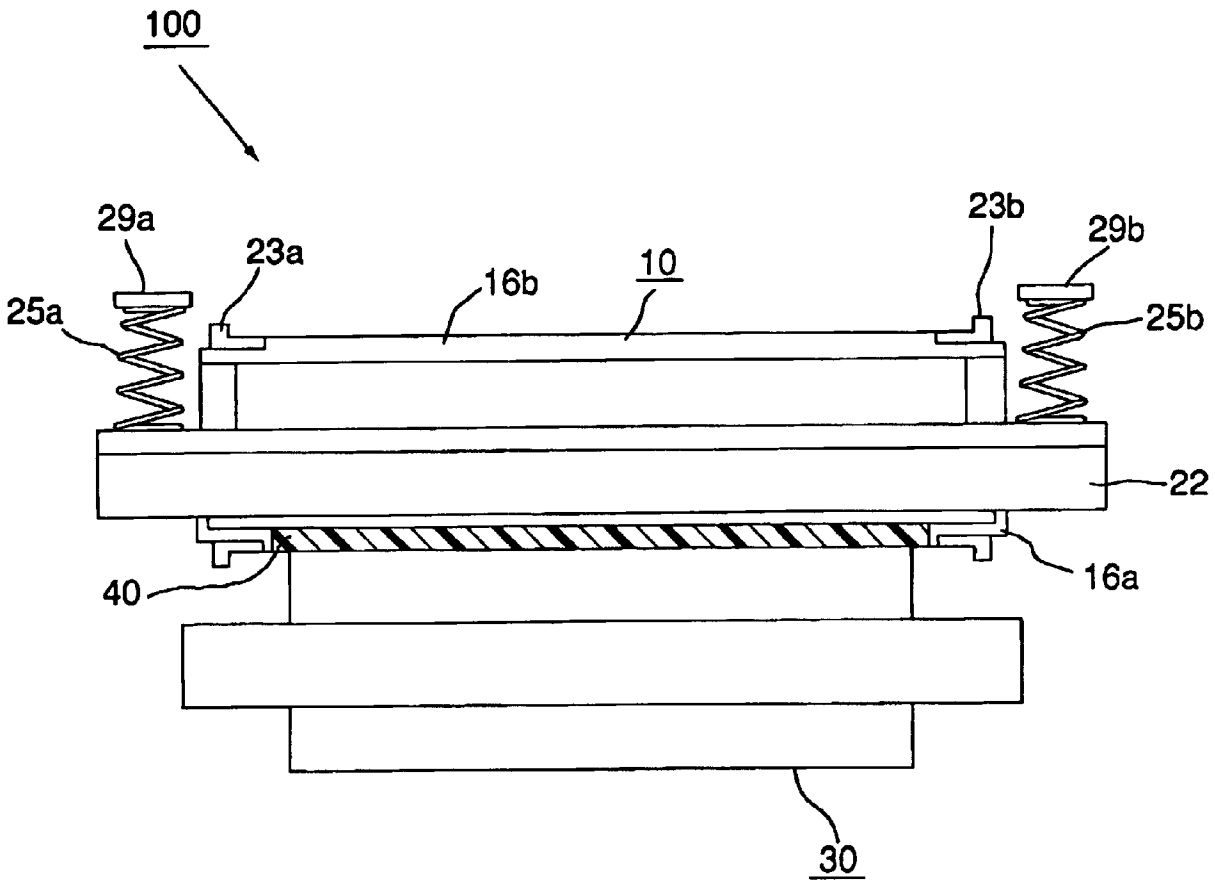
FIG. 3 is a schematic sectional view of the essential portions of the fixing apparatus in FIG. 1 or 2, at the vertical plane, which is parallel to the lengthwise direction of the apparatus, and which coincides with the axial line of the pressure roller.

FIG. 1 is a schematic cross sectional view of the essential portions of the fixing apparatus 100, one of the embodiments of the present invention, at a plane perpendicular to the lengthwise direction of the fixing apparatus 100. FIG. 2 is a front view of the essential portions of the fixing apparatus 100. FIG. 3 is a vertical sectional view of the essential portions of the fixing apparatus 100, at the vertical plane which coincides with the axial line of the pressure roller 30.

This apparatus 100 comprises: a cylindrical film guiding member 16 as a supporting member; a cylindrical fixing film 10*a*, as a flexible movable member (heating member), which is loosely fitted around the film guiding member 16, and in which heat can be generated by electromagnetic induction; and a pressure roller 30, as a pressing member, which is kept pressed upon the film guiding member 16, forming a nipping portion N between the pressure roller 30 and film guiding member 16, with the fixing film sandwiched between the pressure roller 30 and film guiding member 16.

The cylindrical film guiding member (film supporting member) 16 comprises the left and right halves 16*a* and 16*b*, which are virtually semicylindrical, and which are joined at their straight edges, forming a cylinder, or the cylindrical film guiding member 16. Referring to FIG. 1, within the hollow of the semicylindrical right half 16*a* of the film guiding member 16, the combination of magnetic cores 17*a*, 17*b*, and 17*c*, and an exciting coil 18, as a magnetic field generating means, is disposed.

The pressure roller 30 as a pressing member comprises: a metallic core 30*a*; a heat resistant elastic layer 30*b*, which covers the peripheral surface of the metallic core 30*a*; and a release layer 30*c* as the surface layer. The elastic layer 30*b* is in the form of a cylindrical roller, and is formed of a heat resistant substance such as silicone rubber, fluorinated rubber, or fluorinated resin. The axial line of the elastic layer 30*b* coincides with that of the metallic core 30*a*. As the material for the release layer 30*c*, one of such substances, as fluorinated resin, silicone resin, fluoro-silicone rubber, fluorinated rubber, silicone rubber, PFA, PTFE, FEP, etc., that is superior in release properties and heat resistance, can be selected. The pressure roller 30 is rotationally supported between the unshown side walls of the chassis of the apparatus 100, with the lengthwise end portions of the metallic core 30*a* being rotationally supported by the bearings attached to the side walls.

The film guiding member 16, around which the fixing film 10 is fitted, is above the pressure roller 30. Put through the hollow of the film guiding member 16 is a rigid stay 22 for pressure application. Between the lengthwise end portions of the rigid stay 22 and the spring seats 29*a* and 29*b*, a pair of pressure application springs 25*a* and 25*b* are disposed, one for one, in the compressed state, keeping thereby the rigid stay 22 pressed downward. Therefore, the bottom surface of the film guiding member 16, and the top surface of the pressure roller 30, are kept pressed on each other, with the interposition of the fixing film 10, forming a fixing nip N with a predetermined width in terms of the recording medium conveyance direction.

The pressure roller 30 is rotationally driven by a driving means M (FIG. 1) in the counterclockwise direction indicated by an arrow mark. As the pressure roller 30 is rotationally driven, the fixing film 10 is driven by the rotation of the pressure roller 30 (pressure roller driving method), with the inward surface of the fixing film 10 being kept in contact with the bottom surface of the film guiding member 16, in the fixing nip N, due to the presence, in the fixing nip N, of the friction between the peripheral surface of the pressure roller 30 and the outward surface of the fixing film 10. Therefore, the fixing film rotates around the film guiding member 16 in the clockwise direction indicated by another arrow mark, at virtually the same velocity as the peripheral velocity of the pressure roller 30, remaining in contact with the film guiding member 16.

In order to reduce the friction between the bottom surface of the film guiding member 16 and the inward surface of the fixing film 10, the film guiding member 16 is provided with a slippery member 40, which is heat resistant and low in friction. The slippery member 40 is attached to the bottom surface of the film guiding member 16, covering the bottom surface of the film guiding member across the area corresponding to the fixing nip N. The slippery member 40 constitutes a part of the film guiding member 16, to which the slippery member 40 is attached. It is superior to the film guiding member 16, in terms of the slipperiness against the inward surface of the fixing film 10. As the material for the slippery member 40, polyimide resin, glass, alumina, glass coated alumina, etc., are desirable. The slippery member 40 in this embodiment comprises a substrate formed of alumina, and a layer of glass covering the substrate. As described above, the slippery member 40 may be considered to be a part of the fixing film supporting member. Instead of employing the slippery member 40, the bottom surface of the film guiding member 16 may be processed so that the bottom surface itself becomes satisfactorily slippery.

The slippery member 40 is in the form of a piece of narrow belt or tape, and its length and width are no less than the length and width of the fixing nip N, respectively. In this embodiment, it is fitted in the groove cut in the bottom surface of the film guiding member 16, in the lengthwise direction of the film guiding member 16, being thereby accurately positioned as well as securely held therein. It is desired that the slippery member 40 is attached with the use of a heat resistant glue.

Further, in order to reduce the friction between the fixing film 10 and slippery member 40, a lubricant G is placed between the slippery member 40 and the inward surface of the fixing film 10. In this embodiment, a fluorinated grease is used as the lubricant.

The structure of the portion of the film guiding member 16 next to the fixing film sliding portion, and the structure of the portion of the slippery member 40 next to the fixing film sliding portion, in the fixing nip N, will be described later in detail, in Section (5).

Figure 4:
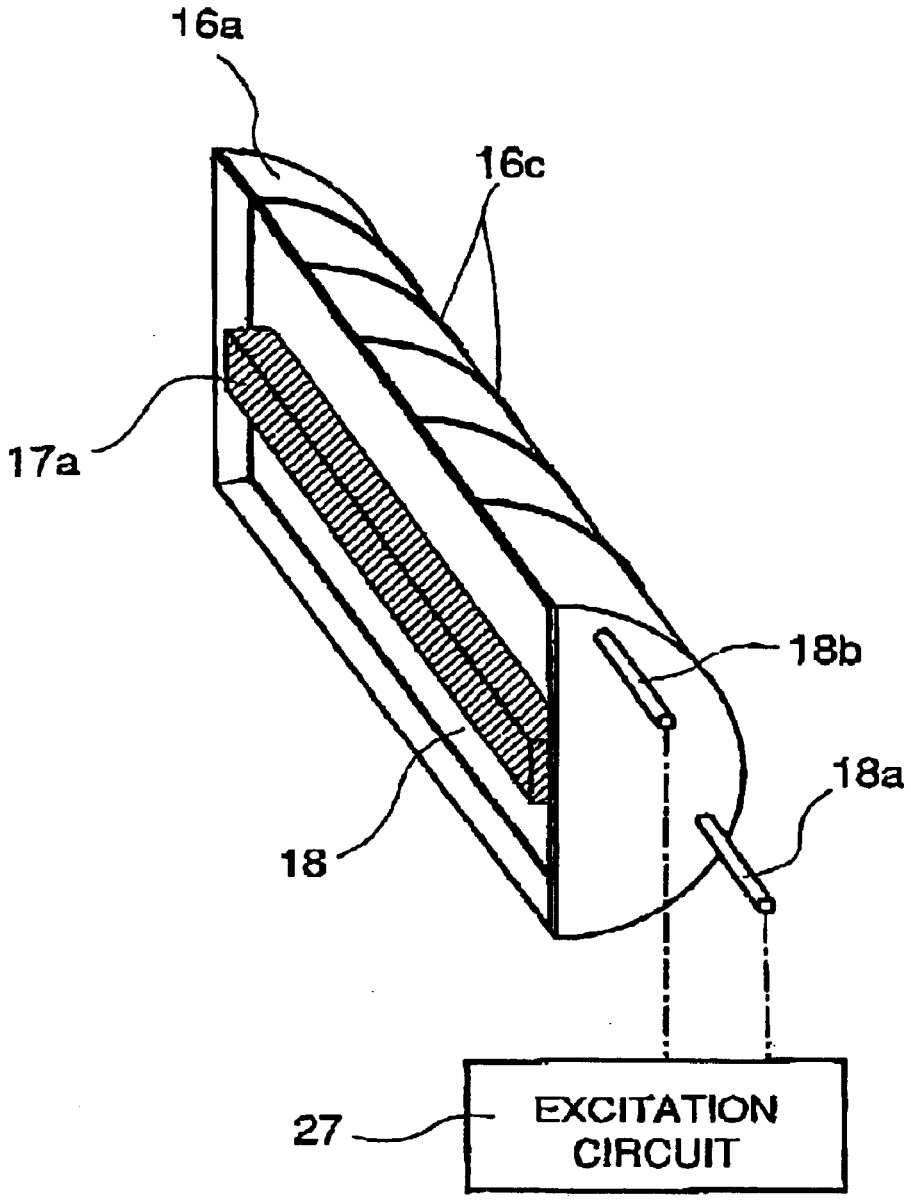
FIG. 4 is a schematic perspective view of the right half of the film guiding member in which the magnetic field generating means is disposed.

Referring again to FIG. 1, the right half 16*a* of the film guiding member 16*a* has a plurality of ribs 16*c*, as shown in FIG. 4, which are on the peripheral surface of the right half 16*a*, with the presence of a predetermined interval between adjacent two ribs in terms of the lengthwise direction of the film guiding member 16. These ribs 16*c* reduce the friction between the right half 16*a* of the film guiding member 16 and the inward surface of the fixing film 10, reducing thereby the rotational load (slide resistance) to which the fixing film 10 is subjected. These ribs 16*c* may also be placed on the peripheral surface of the left half 16*b* of the film guiding member. The shape of the rib is optional; any shape will do as long as it allows the ribs 16*c* to reduce the friction between the fixing film 10 and film guiding member 16.

Referring to FIG. 2, referential numerals 23*a* and 23*b* stand for a pair of flanges fitted around the front and rear end portions of the film guiding member 16, one for one. They prevent the fixing film from becoming offset in terms of the lengthwise direction of the film guiding member 16 while the fixing film 10 is rotationally driven; if the fixing film 10 becomes offset while being rotationally driven, it comes into contact with one of the flanges 23*a* and 23*b*, being therefore prevented from becoming further offset. The flanges 23*a* and 23*b* may be made rotatable so that they rotate with the fixing film as the fixing film comes into contact with the flange 23*a* or 23*b*.

With the provision of the above described structural arrangement, as the pressure roller 30 is rotationally driven, the fixing film 10 is rotated by the rotation of the pressure roller 30. Meanwhile, electrical power is supplied to the exciting coil 18 from an exciting circuit 27 (FIG. 4), generating a magnetic field, which induces electric current in the fixing film 10 as a heating member. As a result, heat is generated in the fixing film 10, heating the fixing nip N to a predetermined temperature. Once the temperature of the fixing nip N is raised to the predetermined level, control is executed so that the temperature of the fixing nip N is kept at this predetermined level. With the temperature of the fixing nip N kept at this level, a recording medium P bearing an unfixed toner image t is conveyed from the unshown image forming means to the fixing nip N, and is introduced between the fixing film 10 and pressure roller 30. Then, the recording medium P is conveyed through the fixing nip N, along with the fixing film 10, remaining nipped by the fixing film 10 and pressure roller 30, with the image bearing surface of the recording medium P being pressed against the outward surface of the fixing film 10.

After passing through the fixing nip N, the recording medium P separates from the outward surface of the fixing film 10, and is conveyed further to be discharged from the apparatus main assembly. After passing through the fixing nip N, the thermally fixed toner image on the recording medium P cools down, turning into a permanent image.

Since this embodiment of a thermal fixing apparatus 100 in accordance with the present invention uses a toner t containing ingredients which do not easily soften, it is not equipped with an oil application mechanism for offset prevention. However, a fixing apparatus employing a toner containing no ingredients which do not easily soften may be equipped with an oil application mechanism. Further, even a fixing apparatus which uses a toner containing ingredients which do not easily soften may be equipped an oil application mechanism, or a cooling mechanism for recording medium separation.

(3) Magnetic Field Generating Means

The magnetic cores 17*a*, 17*b*, and 17*c* are desired to be high in permeability. Therefore, the materials, such as ferrite, Permalloy, etc., used as a transformer core are preferable as the material for the magnetic cores 17*a*, 17*b*, and 17*c*. More preferably, such a ferrite that is low in loss even at a frequency of 100 kHz or more should be used.

The material for the exciting coil 18, which constitutes a magnetic field generating means, is a set of several pieces of fine copper wires, each of which is coated with electrically insulating substance. These copper wires are bundled and wound several times (twelve times in this embodiment) to form the exciting coil 18.

In consideration of the fact that the heat is generated in the fixing film 10, the substance with which the aforementioned copper wires are coated is desired to be heat resistant. For example, polyamide, polyimide, or the like, is recommendable. The insulating substance applied to the fine wires in this embodiment is polyimide, and is capable of remaining insulating up to 220° C.

The wire density of the exciting coil 18 may be increased by the application of external pressure.

Disposed between the magnetic field generating means 17*a*•17*b*•17*c*•18 and the rigid pressure application stay 22 is an insulating member 19. Not only is the material for the insulating member 19 desired to be superior in insulating properties, but also heat resistant. For example, phenol resin, fluorinated resin, polyimide resin, polyamide resin, polyamide-imide resin, polyether-ketone resin, polyesersulfone resin, polyphenylene sulfide resin, PFA resin, PTFE resin, FEP resin, LCP resin, etc., are the recommendable choices.

Figure 5:
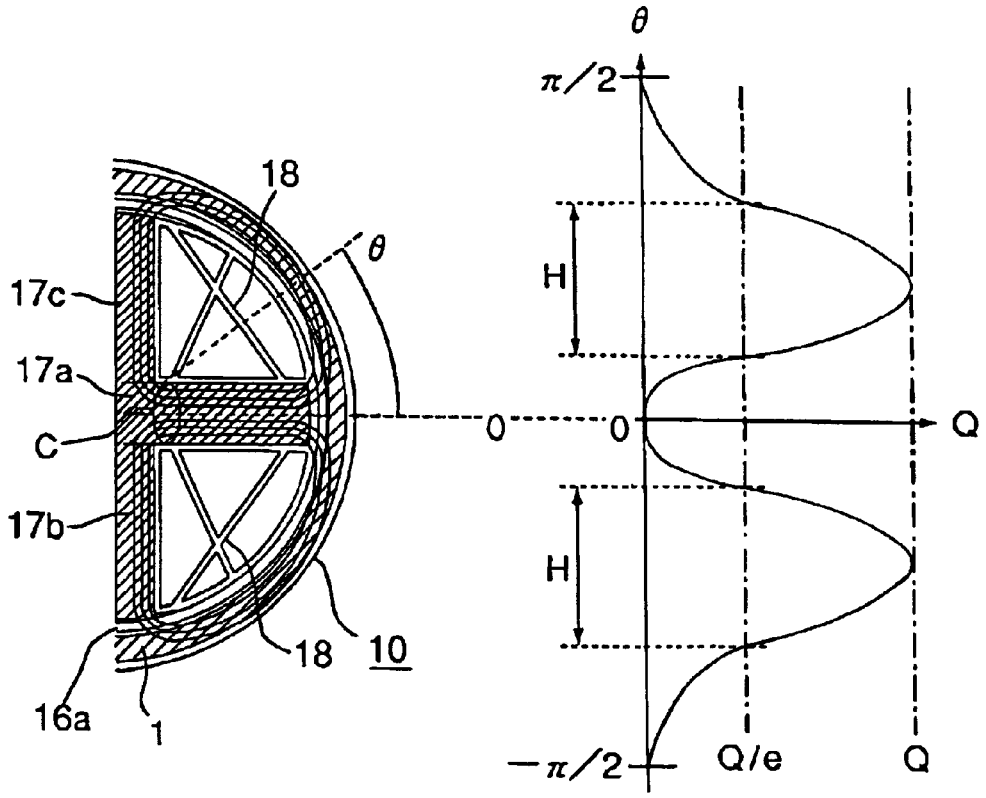
FIG. 5 is a drawing showing the relationship between the magnetic field generating means, and the amount Q generated in the fixing film.

FIG. 5 is a schematic drawing for showing the distribution of the alternating magnetic flux generated by the magnetic field generating means. A magnetic flux C is a part of the alternating magnetic flux generated by the magnetic field generating means. The alternating magnetic flux C directed by the magnetic cores 17*a*, 17*b*, and 17*c* generates eddy current in the portions of the heat generation layer 1 of the fixing film 10 which are between the magnetic cores 17*a* and 17*b*, and between the magnetic cores 17*a* and 17*c*. These eddy currents generate Joule heat (eddy current loss) in the heat generation layer 1 due to the presence of the specific resistance of the heat generation layer 1.

The amount Q of the heat generated in the heat generation layer 1 is determined by the density of the magnetic flux C which passes through the heat generation layer 1, and shows such a distribution pattern that is represented by the graph in FIG. 5, in which the axis of ordinates represents the angular position θ of a given point in the fixing film 10, relative to the plane which vertically halves the magnetic core 17*a*, and the axis of abscissas represents the amount Q of the heat generated in the heat generation layer 1 of the fixing film 10. The definition of a range H is the angular range in which the amount of the heat generated in the heat generation layer 1 is no less than Q/e (Q: maximum amount of heat generated; e: base of natural logarithm). In other words, the range H is the angular range in which heat is generated by an amount necessary for a fixation process.

The current supplied to the exciting coil 18 is controlled by an unshown temperature controlling system, inclusive of a temperature detecting means 26 (FIG. 1), so that the temperature of the fixing nip N remains at a predetermined level. The temperature detecting means 26 is a temperature sensor, for example, a thermistor, for detecting the temperature of the fixing film 10. In this embodiment, the temperature of the fixing nip N is controlled based on the temperature of the fixing film 10 measured with a thermistor.

(4) Fixing Film (Flexible Movable Member) 10

Figure 6:
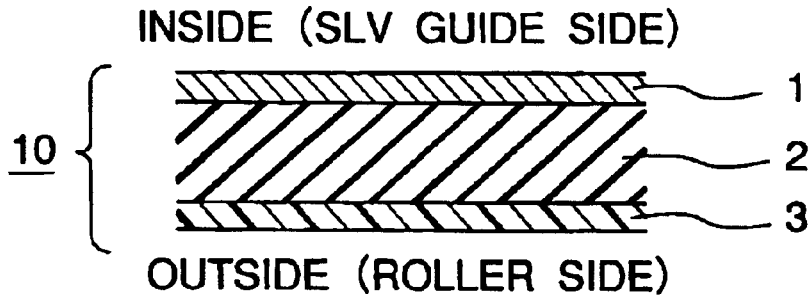
FIG. 6 is a sectional view (1) of the fixing film in which heat is generated by electromagnetic induction, for showing the laminar structure thereof.

FIG. 6 is a schematic sectional view of the fixing film 10 in this embodiment, for showing the structure thereof.

The fixing film 10 in this embodiment is a multilayer film comprising: the heat generation layer 1, a base layer, formed of metallic film, in which heat can be generated by electromagnetic induction; an elastic layer 2 layered on the outward surface of the heat generation layer 1; and a release layer 3 layered on the outward surface of the elastic layer 2.

For adhesion, a primer layer (unshown) may be added between the heat generation layer 1 and elastic layer 2, and between the elastic layer 2 and release layer 3.

The fixing film 10 is virtually cylindrical, and its heat generation layer 1 constitutes the most inward layer which contacts the slippery member 40, whereas the release layer 3 constitutes the most outward layer which contacts the pressure roller or recording medium (object to be heated).

As described above, as the alternating magnetic flux acts on the heat generation layer 1, eddy current is induced in the heat generation layer 1, generating heat in the heat generation layer 1. This heat is used to heat the recording medium P to thermally fix the toner image t while the recording medium P is passed through the fixing nip N.

a. Heat Generation Layer 1

As the material for the heat generation layer 1, a magnetic or nonmagnetic metal can be used. However, a magnetic metal, for example, nickel, iron, ferromagnetic stainless steel, nickel-cobalt alloy, Permalloy, etc., is preferable. In consideration of the fatigue resulting from the repetitive stress which occurs as the fixing film 10 is rotationally driven, the combination of nickel and a small amount of manganese may be used.

The thickness of the heat generation layer 1 is desired to be no less than the penetration depth σ [m] defined as follows, and no more than 200 μm, because when the thickness of the heat generation layer 1 in this range, the heat generation layer 1 efficiently absorbs electromagnetic waves, generating therefore a greater amount of heat.

$$\sigma=503\times(\rho/f\mu)^{1/2} \quad (1)$$

f: frequency of exciting circuit [Hz]

μ: permeability of heat generation layer 1; and

ρ: specific resistance of heat generation layer 1 [Ωm].

Figure 8:
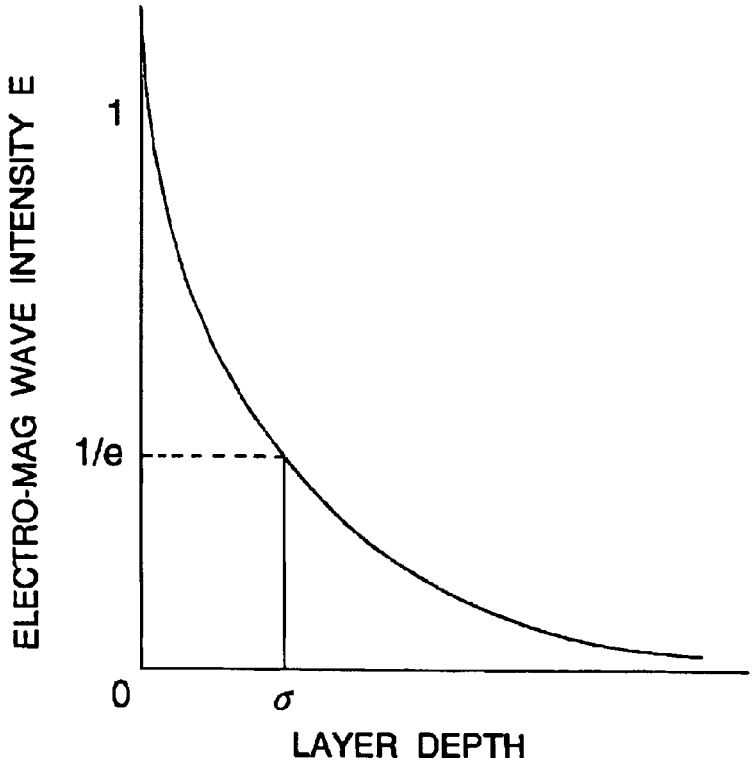
FIG. 8 is a graph showing the relationship between the thickness of the heat generation layer and the strength of electromagnetic waves at a given point in the beat generation layer.

The penetration depth a shows the depth from the surface of a given component, beyond which the strength of magnetic waves is less than 1/e. To state in reverse, virtually the entire energy of the electromagnetic waves will be absorbed by the time the electromagnetic waves reach this depth (see relationship between heat generation depth and electromagnetic wave strength, in FIG. 8).

It is preferred that the thickness of the heat generation layer 1 is in the range of 1–100 μm. If the thickness of the heat generation layer 1 is no more than the above range, the heat generation layer 1 fails to absorb all of the electromagnetic energy; it is inefficient. In comparison, if the thickness of the heat generation layer 1 is no less than the above range, the heat generation layer 1 is too rigid, being inferior in terms of flexibility. In other words, it is impractical to make the heat generation layer 1 thicker than the above range.

b. Elastic Layer 2

It is desired that the elastic layer 2 is formed of a heat resistant and highly heat conductive substance, for example, silicone rubber, fluorinated rubber, fluoro-silicone rubber, or the like.

In order to assure that an image is satisfactorily fixed, the thickness of the elastic layer 2 is desired to be in the range of 10–100 μm. In the case of a color image forming apparatus, its elastic layer 2 is desired to be in the range of 50–500 μm for the following reason. When making a color print, in particular, a photographic color print or the like, large solid areas of color are often formed across a recording medium P. In such a case, if the heating surface (or release layer 3) of the fixing film sometimes fails to perfectly conform to the surface irregularities of the recording medium P or toner layer t, the recording medium P and/or toner layer t is nonuniformly heated, resulting in the formation of a print nonuniform in glossiness; the areas to which more heat is transmitted become different in glossiness from the areas to which less heat is transmitted, the former being higher in glossiness than the latter. If the thickness of the elastic layer 2 is no more than the above range, the release layer 3 fails to perfectly conform to the surface irregularities of the recording medium P or toner layer t, resulting in the formation of an image nonuniform in glossiness. On the contrary, if the thickness of the elastic layer 2 is no less than the above range, the thermal resistance is too large to make it possible for a fixing apparatus to quickly start.

If the hardness of the elastic layer 2 is too high, the elastic layer 2 fails to perfectly conform to the irregularities of the recording medium P or toner layer t, resulting in the formation of an image nonuniform in glossiness. Thus, the hardness of the elastic layer 2 is desired to be no more than 60° (JIS-A), preferably, no more than 40° (JIS-A).

The thermal conductivity λ of the elastic layer 2 is desired to be in the range of $2.5\times10^{-1}$–$8.4\times10^{-1}$ W/m·° C. If the thermal conductivity λ of the elastic layer 2 is no more than the above range, the thermal resistance is too large, delaying the temperature increase at the surface layer (release layer 3) of the fixing film 10. On the other hand, if the thermal conductivity A of the elastic layer 2 is no less than the above range, the elastic layer 2 is too hard, or is likely to be permanently deformed by compression. It is preferable that the thermal conductivity of the elastic layer 2 is in the range of $3.3\times10^{-1}$–$6.3\times10^{-1}$ W/m·° C.

c. Release Layer 3

The release layer 3 is formed of such a material as fluorinated resin, silicone resin, fluorosilicone rubber, fluorinated rubber, silicone rubber, PFA, PTFE, FEP, etc., that is superior in releasing properties as well as heat resistance.

The thickness of the release layer 3 is desired to be in the range of 1–100 μm. An attempt to form a release layer 3, the thickness of which is no more than the above range, results in the formation of a release layer 3 which is nonuniform in thickness, being therefore inferior in releasing properties across some areas, and being not durable, which is a problem. On the other hand, if the thickness of the release layer 3 is no less than the above range, the release layer 3 is inferior in thermal conductivity. In particular, when a resinous substance is used as the material for the release layer 3, the release layer 3 is too hard, nullifying the effects of the elastic layer 3.

d. Thermal Insulation Layer 4

Figure 7:
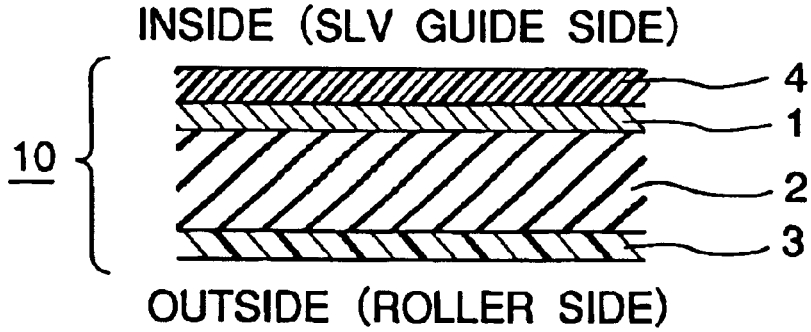
FIG. 7 is a sectional view (2) of the fixing film in which heat is generated by electromagnetic induction, for showing the laminar structure thereof.

Referring to FIG. 7, the fixing film 10 may be provided with a thermal insulation layer 4, which is placed on the surface of the heat generation layer 1 facing the slippery member 40. As for the material for the thermal insulation layer 4, a heat resistant resin, for example, fluorinated resin, polyimide resin, polyamide resin, polyamide-imide resin, PEEK resin, PES resin, PPS resin, PFA resin, PTFE resin, FEP resin, etc., is recommendable.

The thickness of the thermal insulation layer 4 is desired to be in the range of 10–1,000 μm. If the thermal insulation layer 4 is no more than 10 μm, the thermal insulation layer 4 is not effective as a thermal insulation layer, and also falls short in durability. On the other hand, if the thickness of the thermal insulation layer 4 exceeds 1,000 μm, the distances from the magnetic cores 17*a*, 17*b*, and 17*c*, and exciting coil 18, to the heat generation layer 1 is too large; it is impossible for the magnetic flux to be absorbed by a sufficient amount by the heat generation layer 1.

The thermal insulation layer 4 prevents the heat generated in the heat generation layer 1, from being transmitted inward of the fixing film 10. Therefore, a fixing film 10 with the thermal insulation layer 4 is superior to a fixing film without the thermal insulation layer 4, in terms of the ratio of the heat supplied to the recording medium P, being therefore smaller in power consumption.

Further, the selection of a slippery substance as the material for the thermal insulation layer 4 makes it possible to reduce the friction between the slippery member 40 and fixing film 10.

(5) Structure of Adjacencies of Fixing Film Sliding Portion

Figure 9:
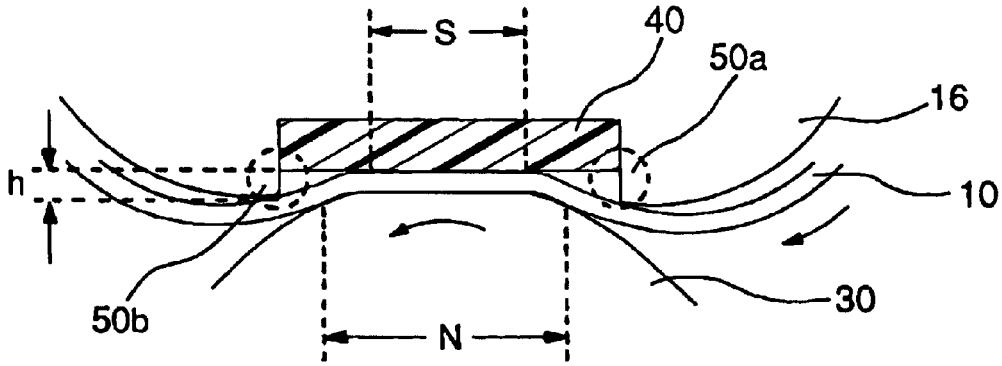
FIG. 9 is a schematic sectional view of the adjacencies of the fixing film sliding surface of the film supporting member.

FIG. 9 is a schematic cross sectional view of the adjacencies of the fixing film sliding portion, or the interface between the fixing film 10 and slippery member 40, in the fixing nip N. In order to make it easier for a recording medium to separate from the fixing film 10, the slippery member 40 is disposed so that its downwardly facing surface is recessed from the downwardly facing portion of the outward surface of the film guiding member 16, creating stair-like portions 50*a* and 50*b* in the downward surface of the film guiding member 16, on the upstream and downstream sides, respectively, with respect to the fixing film sliding portion S between the slippery member attached to the film guiding member 16, and the fixing film 10, in terms of the moving direction of the fixing film 10.

The stair-like portion 50*b*, or the downstream stair-like portion of the film guiding member 16 with respect to the fixing film sliding portion S, in terms of the moving direction of the fixing film 10, contributes to the recording medium separation from the fixing film 10. The height h of the stair-like portion 50*b* from the outwardly facing surface of the slippery member 40 has only to be no less than 0.1 mm and no more than 1.0 mm. If the height h is no more than 0.1 mm, a recording medium does not always satisfactorily separate from the fixing film 10, resulting sometimes in the occurrence of the so-called wraparound paper jam in the fixing device. On the contrary, if the height h is no less than 1.0 mm, a recording medium becomes excessively curled as it is passed through the fixing nip N. Further, if the heat generation layer 1 of the fixing film 10 is formed of metallic substance as is the heat generation layer 1 in this embodiment, the greater the height h, the greater the stress to which the fixing film 10 is subjected as it is rotated, and therefore, the sooner the fixing film 10 is likely to break due to fatigue. Thus, it is preferred that the height h is no more than 0.5 mm. In this embodiment, the height h is 0.3 mm.

Figure 10:
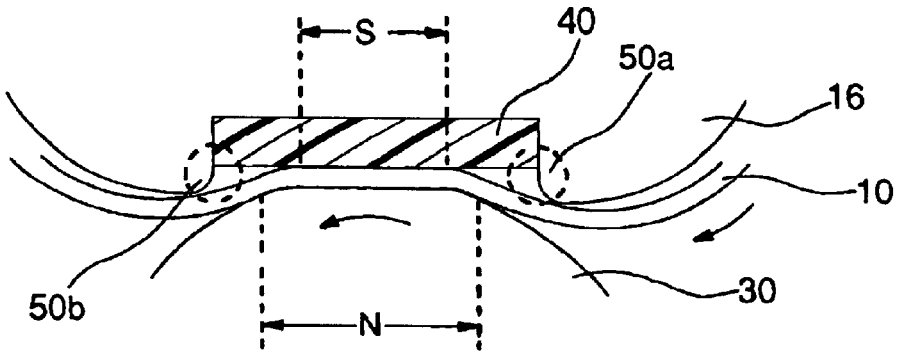
FIG. 10 is a schematic sectional view of a modified version of the adjacencies of the fixing film sliding surface shown in FIG. 9.

Referring to FIG. 10, in order to reduce the amount of the mechanical damage caused to the inward surface of the fixing film 10 by the edges of the stair-like portions 50*a* and 50*b* of the outward surface of the film guiding member 16, the edges may be rounded by chamfering.

Figure 11:
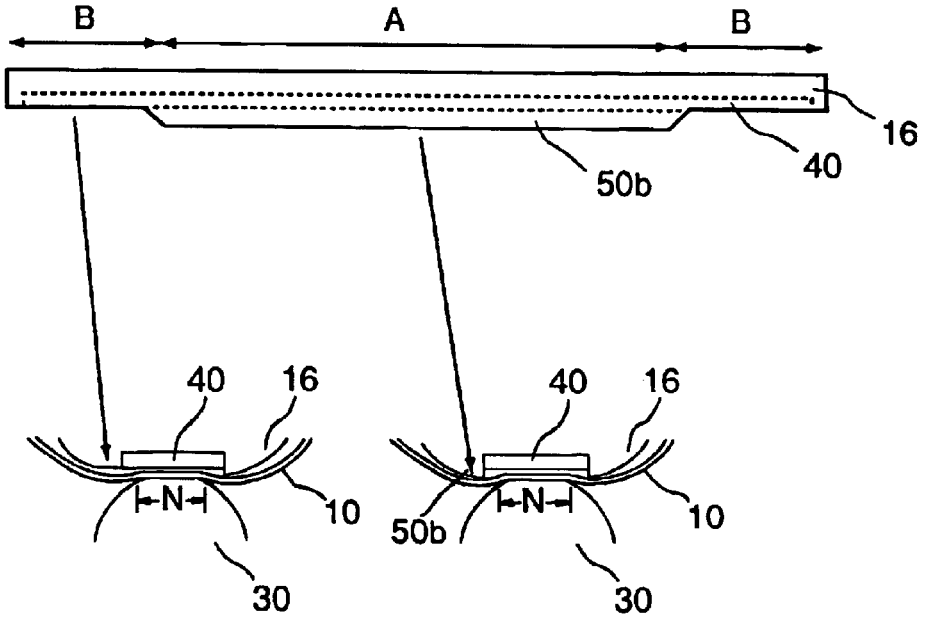
FIG. 11 is a schematic front view of the ridge of the film supporting member, and its adjacencies, as seen from downstream in terms of the direction in which the fixing film moves.

FIG. 11 is a sectional plan view of the stair-like portion 50*b*, that is, the downstream stair-like portion of the film guiding member 16, with respect to the fixing film sliding portion S, as seen from downstream the direction in which the fixing film moves. In the drawing, a range A represents the minimum width, in terms of the lengthwise direction of the film guiding member 16, which the downstream stair-like portion 50*b*, with respective to the fixing film sliding portion S, requires to satisfactorily separate the portion of a recording medium covered by the toner image thereon. In other words, the range A corresponds to the maximum image width. A ranges B represent the portions of the guiding member 16, which is outside the range A, and the portions of the stair-like portion 50*b* in these ranges B are virtually level with the outwardly facing surface of the slippery member 40. In consideration of the durability of the fixing film 10, the transition between the ranges A and B is desired not to be abrupt; it is desired to be gradually tapered, or the edge forming portions may be rounded. In the ranges B, the grease on the inward surface of the fixing film 10 is not scraped away, remaining on the inward surface of the fixing film 10. Therefore, the body of grease remaining on a given point of the inward surface of the fixing film 10 is moved to the upstream adjacencies of the fixing film sliding portion S (FIG. 9) by the rotation of the fixing film 10, being allow to re-enter the fixing film sliding portion S. The body of grease expelled from the range A into the ranges B also is moved to the upstream adjacencies of the fixing film sliding portion S, along with the bodies of grease preexisting in the ranges B. In other words, the body of grease scraped away by the stair-like portion of the film guiding member 16 does not ooze from the lateral edges of the fixing film 10; it remains on the fixing film 10, further reducing the friction between the fixing film 10 and film guiding member 16.

In this embodiment, the downstream stair-like portion 50*b* (FIG. 9) with respect to the fixing film sliding portion S is recessed across the ranges B. However, the upstream stair-like portion 50*a* (FIG. 9) may also be recessed across the ranges B. When the upstream stair-like portion 50*a* is recessed across the ranges B, the amount by which the grease on the inward surface of the fixing film 10 is scraped away by the upstream stair-like portion 50*a* is smaller, making it possible to more efficiently send grease into the fixing film sliding portion S. Incidentally, all that is required of the portions of the stair-like portions 50*a* and 50*b* in the ranges B is that they are structured so that they are smaller in the amount by which they scrape away the grease on the fixing film 10, than the portions of the stair-like portions 50*a* and 50*b* in the range A. Therefore, it is not mandatory that they are level with the fixing film sliding portion S; they may be such that with reference to the fixing film sliding portion S, they are lower than the portions of the stair-like portions 50*a* and 50*b* in the range A.

Figure 12:
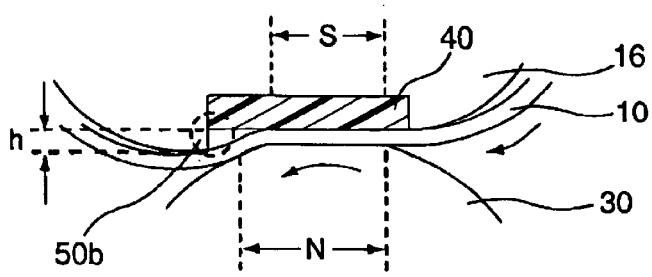
FIG. 12 is a drawing (2) for describing the shape of the ridge.

Referring to FIG. 12, the film guiding member 16 may be provided with only the stair-like portion 50*b*, or the downstream stair-like portion which contributes to the recording medium separation; the portion of the film guiding member 16 in the upstream adjacencies of the fixing film sliding portion S may not be provided with a stair-like portion. With the employment of such a structural arrangement, it does not occur that the grease on the inward surface of the fixing film 10 is scraped away by an upstream stair-like portion of the film guiding member 16 with respect to the fixing film sliding portion S. In other words, the employment of such a structural arrangement makes it possible to further reduce the friction between the fixing film 10 and film guiding member 16.

Further, rendering the inward surface of the fixing film 10 rougher increases the grease retention by the inward surface of the fixing film 10, contributing to the further reduction of the friction between the fixing film 10 and film guiding member 16. The roughness Ra of the inward surface of the fixing film 10 is desired to satisfy the following formula: $0.07 \leqq Ra \leqq 0.5$ [$\mu$m]. Moreover, providing the inward surface of the fixing film 10 with ridges and valleys (grooves) parallel to the moving direction of the fixing film 10 prevents the amount by which the grease moves in the direction perpendicular to the moving direction of the fixing film 10, that is, in the lengthwise direction of the fixing film 10. In other words, providing the inward surface of the fixing film 10 with such grooves is a very effective counter measure against the oozing of the grease from the lateral edges of the fixing film 10.

In this embodiment, the aforementioned stair-like portion (or portions) of the film guiding member 16 for recording medium separation, which protrudes the predetermined distance from the fixing film sliding portion S, is structured so that the range across which it extends matches the range of the path of an image proper on a recording medium. Therefore, virtually the entirety of the grease on the fixing film 10 passes the fixing film sliding portion S by way of the ranges in which the ridge does not protrude as far as the predetermined distance, or a stair-like portion is not present. However, in order to make it easier for the grease to move from the upstream side of the stair-like portion to the downstream side of the stair-like portion, the stair-like portion proper may be provided with slits. If slits are to be formed after the formation of the film guiding member 16, the cost for the slit formation adds to the cost of a fixing apparatus. Even if the slits are formed as the integral parts of the film guiding member 16, it requires a higher degree of manufacture control for the formation of the stair-like portion of the film guiding member 16, adding to the cost of a fixing apparatus. In other words, as long as the cost problem can be managed, the stair-like portion may be provided with the above described slits.

Embodiment 2

Figure 13:
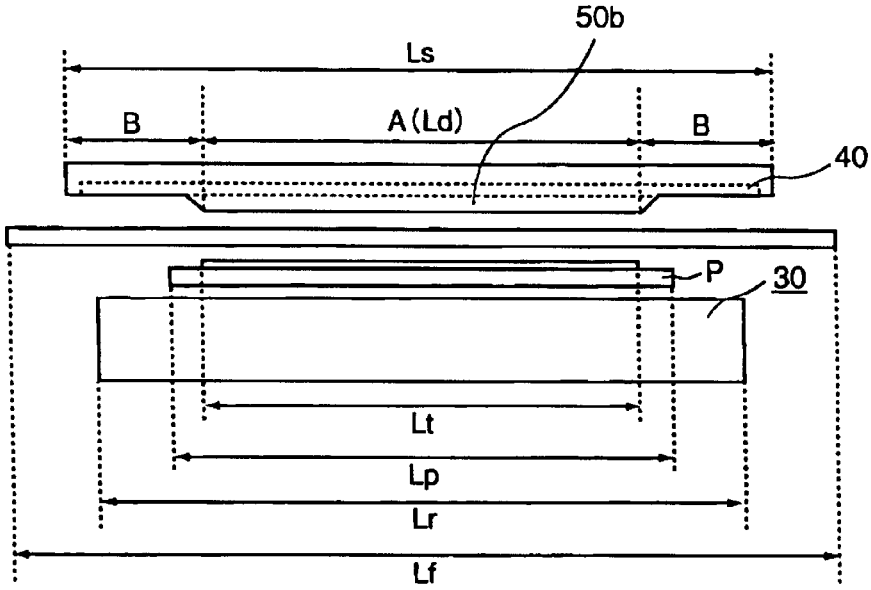
FIG. 13 is a drawing (1) showing the relationship among the dimensions of the various portions of the fixing apparatus, in terms of the lengthwise direction, and also, the pressure roller shape.

FIG. 13 is a schematic drawing for describing the structural arrangement for the second embodiment of an image heating apparatus in accordance with the present invention. In this embodiment, the film guiding member 16 is structured so that the ranges B in Embodiment 1 include the peak of the pressure distribution curve in terms of the lengthwise direction of the fixing nip. More specifically, the width of the nip N in terms of the recording medium conveyance direction is 6 mm at the mid point in terms of the lengthwise direction of the nip N, and gradually widens toward the lengthwise ends of the nip N, being 7 mm at the lengthwise ends. In other words, the compressional pressure in the nip N is highest at the lengthwise ends of the pressure roller. As described before, due to the compatibility between the inward surface of the fixing film 10 and the slippery member 40, "stick-and-slip", that is, the phenomenon that the fixing film repeatedly stops and moves with short intervals, sometimes occurs. This phenomenon is likely to occur when the difference between the static friction and dynamical friction is excessively large. It is also likely to occur where the compressional pressure is higher. Efficiently circulating the grease in the ranges (B), inclusive of the lengthwise end of the nip N at which the compressional pressure is highest, ensures that there will always be grease between the fixing film 10 and slippery member 40. Moreover, grease tends to flow from where pressure is high to where pressure is low. Therefore, the above described structural arrangement in this embodiment makes the grease migrate toward the center of the nip N, in terms of the lengthwise direction of the nip N, from the lengthwise ends of the nip N, preventing the increase in the static friction, and therefore, preventing the occurrence of the "stick-and-slip" phenomenon.

Figure 14:
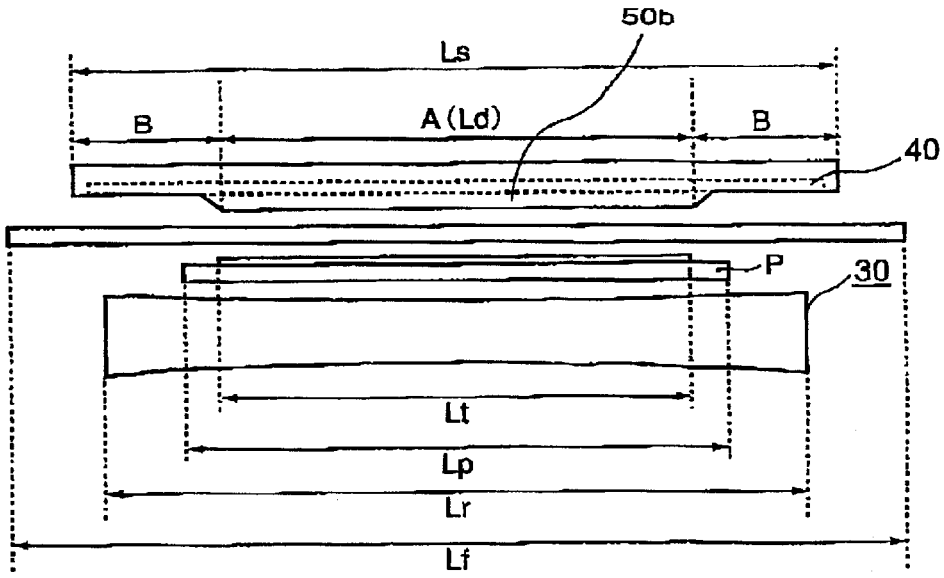
FIG. 14 is a drawing (2) showing the relationship among the dimensions of the various portions of the fixing apparatus, in terms of the lengthwise direction, and also, the pressure roller shape.

Further, referring to FIG. 14, the pressure roller 30 may be shaped so that the diameter of the pressure roller 30 gradually reduces toward the lengthwise center. Not only does such a structural arrangement make it possible to make the grease more efficiently move toward the lengthwise center of the nip N, from the lengthwise ends of the nip N, but also causes the pressure roller 30 to act in a manner to pull a recording medium P from the lengthwise ends, being beneficial from the standpoint of wrinkle prevention.

Figure 15:
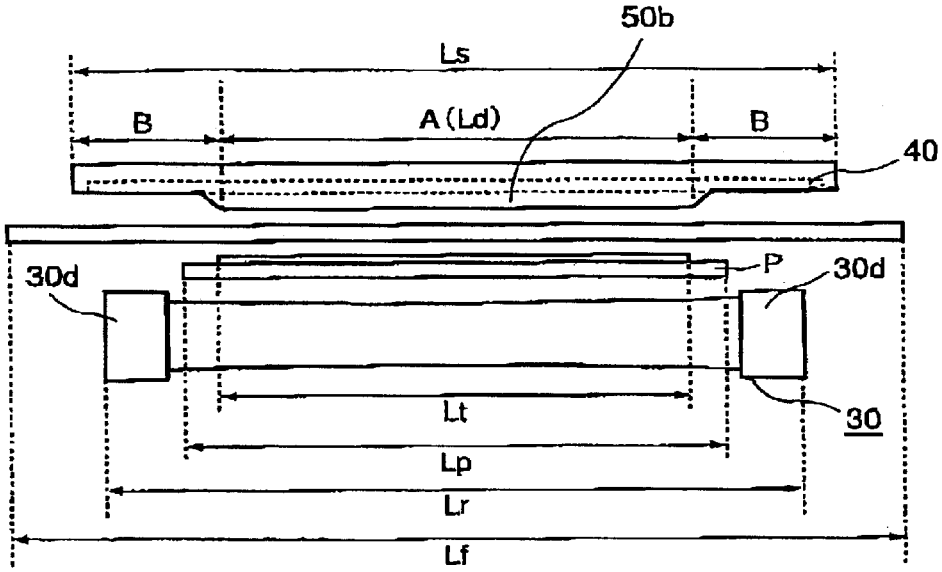
FIG. 15 is a drawing (3) showing the relationship among the dimensions of the various portions of the fixing apparatus, in terms of the lengthwise direction, and also, the pressure roller shape.

Referring to FIG. 15, the pressure roller 30 may be provided with a pair of large diameter portions 30*d*, the diameter of which is substantially larger than the rest of the pressure roller 30, and the position of which falls within the range B. This structural arrangement makes it possible to dam the grease pushed out of the range A. Further, the peripheral surface of the portion 30*d*, the diameter of which is substantially larger than that of the rest of the pressure roller 30, may be processed to increase the friction between itself and the fixing film 10 so that the fixing film 10 is flawlessly conveyed, for example, without slipping. In practical terms, all that is necessary to increase the friction between the large diameter portion 30*d* of the pressure roller 30 and the fixing film 10 is not to provide the large diameter portion 30*d* with the release layer 30*c*, so that the elastic layer 30*b*, the friction between which and the fixing film 10 is greater than the friction between the release layer 30*c* and fixing film 10, is placed directly in contact with the fixing film 10.

Embodiment 3

This embodiment is similar in structure to Embodiments 1 and 2 (FIGS. 13 and 15), except that the various structural components in this embodiment are different in dimension, in terms of the lengthwise direction of the apparatus, from those in Embodiments 1 and 2, and satisfy the following conditions:

$$Lf,\ Ls > Lr > Ld$$

Lf: dimension of fixing film 10 in terms of lengthwise direction of apparatus Ls: length of film guiding member 16

Lr: length of pressure roller 30

Ld: length of stair-like portion 50*b* (portion within range A), that is, downstream stair-like portion with respect to nip N.

When the above conditions were satisfied, satisfactory results were obtained: grease was not expelled at the lateral edges of the fixing film 10, and the grease was efficiently circulated.

The condition: Lr>Ld, is required for the reason described before.

The condition: Ls>Lr, is required for the following reason.

When this condition was satisfied, not only was the grease recirculated within the range, which corresponds in position and length to the nip (pressure roller 30), but also it was circulated in the range outside the range corresponding in position and length to the nip (pressure roller 30). In other words, the body of grease expelled into the range outward of the lengthwise end of the pressure roller 30 was also recirculated. In other words, satisfying this condition is effective to prevent grease from oozing at the lateral edges of the fixing film 10.

Although the present invention is effective regardless of the relationship between Lf and Ls, Lf is preferred to be greater than Ls: Lf>Ls, for the following reason. That is, when the fixing film 10 is longer than the slippery member 40, the former does not contact the latter outside the range of the latter. Thus, even if grease is made to ooze at the lengthwise end of the slippery member 40, it is not made to ooze at the lateral edge of the fixing film 10.

Further, if the following condition is satisfied:

$$Lp>Ld>Lt$$

Lp: width of recording medium P

Lt: maximum width of toner image, the portion of the fixing film, corresponding to the non-image portion (margin portion) of a recording medium P, is different in the curvature from the portion of the fixing film, corresponding to the image bearing portion, the width of which corresponds to the maximum width Lt of the toner image on the recording medium P, when the recording medium is separated from the fixing film. Therefore, the non-image portion (margin portion) of the recording medium P easily separates from the fixing film, improving the efficiency with which the recording medium P separates from the fixing film.

Embodiment 4

This embodiment is similar to Embodiment 1, except that the film guiding member 16 in this embodiment does not have the slippery member 40.

Figure 16:
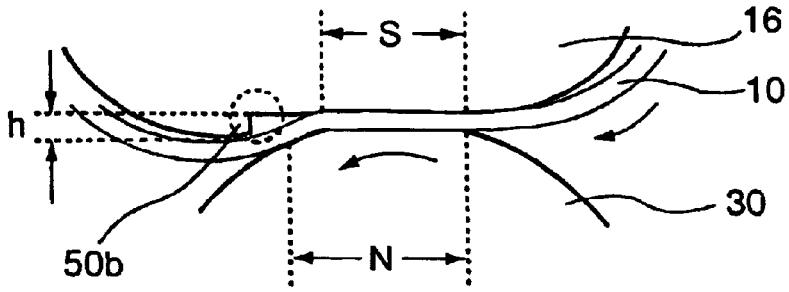
FIG. 16 is a drawing for describing the shape of the ridge of the film guiding member in the fourth embodiment of a fixing apparatus in accordance with the present invention.

FIG. 16 is a schematic sectional view of the fixing film sliding portion S, or the interface between the fixing film 10 and film guiding member 16, and its adjacencies, in the fixing nip N in this embodiment. In this embodiment, the fixing film sliding portion S is the result of the direct contact between the downwardly facing surface of the film guiding member 16 and the inward surface of the fixing film 10; the fixing film slides directly on the downwardly facing surface of the film guiding member 16.

The film guiding member 16 in this embodiment is desired to be formed of a heat resistant substance, such as a heat resistant resin, for example, phenol, resins superior in heat resistance, for example, phenol resin, polyimide resin, polyamide resin, polyamide-imide resin, polyether-ketone resin, polyester-sulfone resin, polyphenylene sulfide resin, LCP resin, etc. Further, the material for the film guiding member 16 in this embodiment is desired to be superior in slipperiness. Therefore, fluorinated resin such as PFA resin, PTFE resin, and FEP resin, or a heat resistant resin containing a substance, such as fluorinated resin, superior in slipperiness, are recommendable as the material for the film guiding member 16 in this embodiment.

This embodiment does not employ the slippery member 40. Therefore, it is lower in cost.

Further, the elimination of the slippery member 40 makes it possible to form the stair-like portion 50*b* as an integral part of the film guiding member 16, making therefore it possible to drastically reduce manufacturing errors regarding the height h of the stair-like portion 50*b*, compared to the structural arrangement in Embodiment 1, in which the stair-like portion 50*b* is created by the combination of the slippery member 40 and film guiding member 16.

Needless to say, in terms of the structure for preventing grease from oozing at the lateral edges of the fixing film 10, and also for reducing the friction between the fixing film 10 and film guiding member 16, the downstream stair-like portion 50*b* in this embodiment is similar to the downstream stair-like portion 50*b* in Embodiment 1.

Otherwise, the structure of the fixing apparatus in this embodiment is the same as the fixing apparatus 100 in Embodiment 1, and therefore, will not be described to avoid the repetition of the same description.

Embodiment 5

Figure 17:
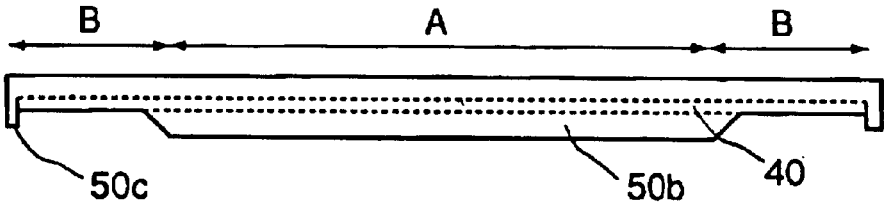
FIG. 17 is a drawing for describing the shape of the ridge of the film guiding member in the fifth embodiment of a fixing apparatus in accordance with the present invention.

Referring to FIG. 17, in this embodiment, in order to more effectively prevent grease from oozing at the lateral edges of the fixing film, a slippery member 40 is provided with a pair of ribs 50*c* for damming grease, which are attached to the lengthwise ends of the slippery member 40, one for one. With the provision of these ribs 50*c*, it is assured that grease is prevented from oozing at the lateral edges of the fixing film. Further, in order to minimize the mechanical damages which these ribs 50*c* might cause to the inward surface of the fixing film 10, the edges of the ribs 50*c* may be rounded as are those of the stair-like portions 50*a* and 50*b*. The distance the ribs 50*c* protrude relative to the fixing film sliding portion S between the slippery member 40 and fixing film 10 has only to be no less than 0.1 mm and no more than 1.0 mm. If the ribs 50*c* are taller than the downstream stair-like portion 50*b* with respect to the nip N, they are very effective to prevent grease from oozing at the lateral edges of the fixing film.

Embodiment 6

Figure 18:
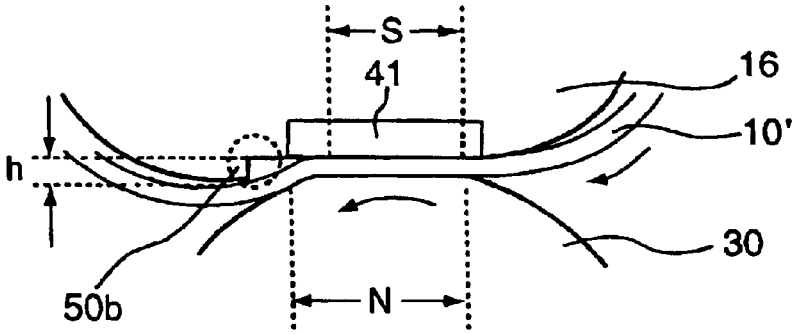
FIG. 18 is a drawing for describing the shape of the ridge of the film guiding member in the sixth embodiment of a fixing apparatus in accordance with the present invention.

FIG. 18 is a schematic drawing for describing the structure of this embodiment of a fixing apparatus in accordance with the present invention. This embodiment of a fixing apparatus comprises: a flexible movable member 10' formed of heat resistant film which does not have a layer in which heat can be generated by electromagnetic induction; a heating member 41, such as a ceramic heater, or a member in which heat can be generated by electromagnetic induction. The heat generating member 41 is attached to the bottom surface of the film guiding member 16, across the portion corresponding to the fixing nip N. In operation, a recording medium bearing an unfixed toner image is introduced between the fixing film 10' and pressure roller 30, in the fixing nip N, and is passed, along with the fixing film 10', through the fixing nip N, remaining nipped by the fixing film 10' and pressure roller 30, so that the heat from the heating member 41 is given to the recording medium through the fixing film 10', while the pressure from the pressure roller 30 is applied to the recording medium, in the fixing nip N. As a result, the unfixed image on the recording medium is fixed to the surface of the recording medium.

Otherwise, the structure of this fixing apparatus is the same as those of the fixing apparatuses 100 in Embodiments 1–5. Therefore, it will not be described to avoid the repetition of the same description.

Embodiment 7

This is an embodiment of an image heating apparatus in accordance with the present invention, in which the portion of the stair-like portion, corresponding in position to the image path, has a plurality of slits, through which grease is allowed to pass the stair-like portion.

Structure of Adjacencies of Fixing Film Sliding Portion

Figure 20:
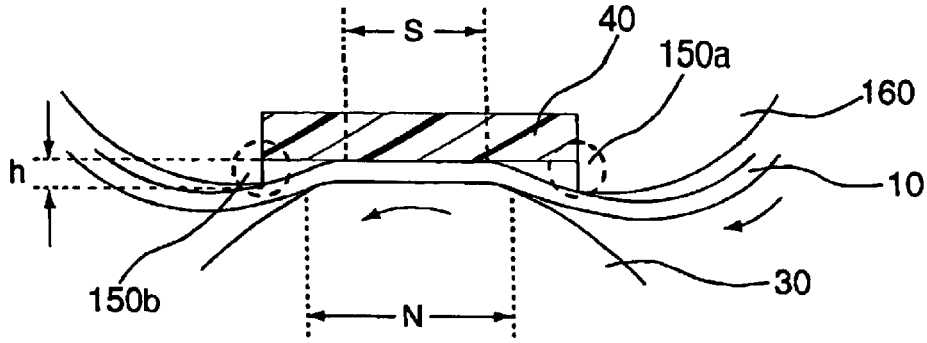
FIG. 20 is a schematic sectional view of the adjacencies of the fixing film sliding portion in the seventh embodiment of an image heating apparatus in accordance with the present invention.

FIG. 20 is a schematic cross sectional view of the adjacencies of the fixing film sliding portion, or the interface between the fixing film 10 and slippery member 40, in the fixing nip N, at a plane perpendicular to the lengthwise direction of the slippery member 40. In order to make it easier for a recording medium to separate from the fixing film 10, a recess deeper than the thickness of the slippery member 40 is cut in the bottom surface of the slippery member 40, and the slippery member 40 is disposed in this recess so that its bottom surface becomes recessed from the downwardly facing portion of the outward surface of the film guiding member 160, creating stair-like portions 150*a* and 150*b*, on the upstream and downstream sides, respectively, with respect to the fixing film sliding portion S between the slippery member 40 attached to the film guiding member 160, and the fixing film 10, in terms of the moving direction of the fixing film 10.

The stair-like portion 150*b*, which is on the downstream side with respect to the fixing film sliding portion S in terms of the moving direction of the fixing film 10 contributes to the recording medium separation from the fixing film 10. The height h of the top edge of the stair-like portion 150*b* from the outwardly facing surface of the slippery member 40 has only to be no less than 0.1 mm and no more than 1.0 mM. If this height h is no more than 0.1 mm, the stair-like portion 150*b* does not satisfactorily contribute to the recording medium separation, resulting sometimes in the occurrence of the so-called wraparound paper jam in the fixing device. On the contrary, if the height h is no less than 1.0 mm, a recording medium becomes excessively curled as it is passed through the fixing nip N. Further, if the heat generation layer 1 of the fixing film 10 is formed of metallic substance as is the heat generation layer 1 in this embodiment, the greater the height h, the greater the stress to which the fixing film 10 is subjected as it is rotated, and therefore, the sooner the fixing film 10 is likely to break due to fatigue. Thus, it is preferred that the height h is no more than 0.5 mm. In this embodiment, the height h is 0.3 Mm.

Figure 21:
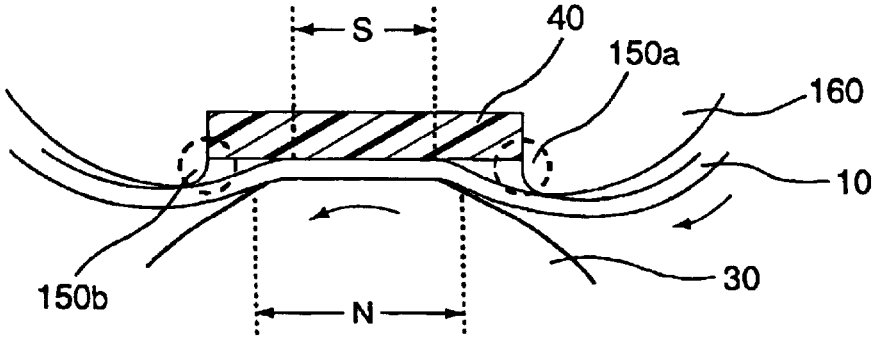
FIG. 21 is a schematic sectional view of a modified version of the adjacencies of the fixing film sliding portion shown in FIG. 20.

Referring to FIG. 21, in order to reduce the amount of the mechanical damage caused to the inward surface of the fixing film 10 by the top edges of the stair-like portions 150*a* and 150*b*, the top edges of the stair-like portions 150*a* and 150*b* may be rounded by chamfering.

Figure 22:
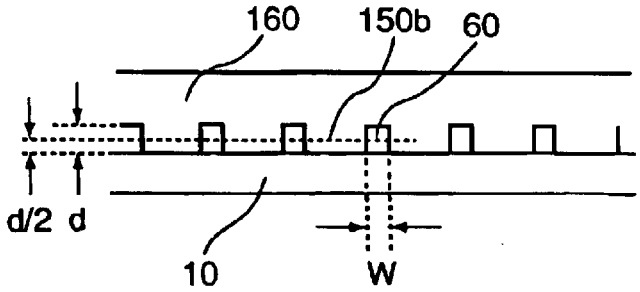
FIG. 22 is a schematic plan view of the ridge of the film guiding member, as seen from downstream in terms of the moving direction of the fixing film.

FIG. 22 is a plan view of the stair-like portion 150*b*, which is on the downstream side with respect to the fixing film sliding portion S, as seen from downstream in terms of the moving direction of the fixing film 10. In order to reduce the friction between the fixing film 10 and the stair-like portion 150*b*, which is on the downstream side with respect to the fixing film sliding portion S, the stair-like portion 150*b* is provided with a plurality of slits 60, which extend in the moving direction of the fixing film 10. The bodies of grease on the portions of the inward surface of the fixing film 10, corresponding in position to the slits 60, are not scraped away; they remain on the inward surface of the fixing film 10. These bodies of grease are moved to the upstream side of the fixing film sliding portion S (FIG. 20) as the fixing film 10 moves. After being moved to the upstream side of the fixing film sliding portion S, these bodies of grease are allowed to enter again the fixing film sliding portion S, contributing again to the reduction of the friction between the fixing film and the stair-like portion 150*b*.

Further, the grease which collects between the fixing film sliding portion S and the downstream stair-like portion 150*b* can be released downstream through the slits 60 as the fixing film 10 is moved. Therefore, even when grease viscosity is relatively high, for example, when the fixing device has not sufficiently warmed up, for example, immediately after the power of the main assembly is turned on, the friction between the fixing film 10 and stair-like portion 150*b* does not increase due to the grease collection between the fixing film sliding portion S and the downstream stair-like portion 150*b*.

The dimension (width) W of the slit 60 in terms of the direction perpendicular to the moving direction of the fixing film 10 is no less than 0.5 mm and no more than 5 mm. In this embodiment, the width W is the width of the slit 60 measured at half the depth d of the slit 60. If the width W is no more than 0.5 mm, it is difficult for grease to move through the slit 60, failing to successfully reduce the friction between the fixing film 10 and stair-like portion. On the other hand, if the width W is no less than 5 mm, the fixing film 10 is likely to crease along the slit 60; once a crease is formed, the pattern of the crease is transferred onto the image being fixed. Further, if a metallic substance is used as the material for the heat generation layer 1 of the fixing film 10 as in this embodiment, the heat generation layer 1, or metallic layer, is likely to be break due to fatigue as the fixing film 10 is bent (creased). In this embodiment, the width W of the slit 60 is 1.0 mm.

Figure 23:
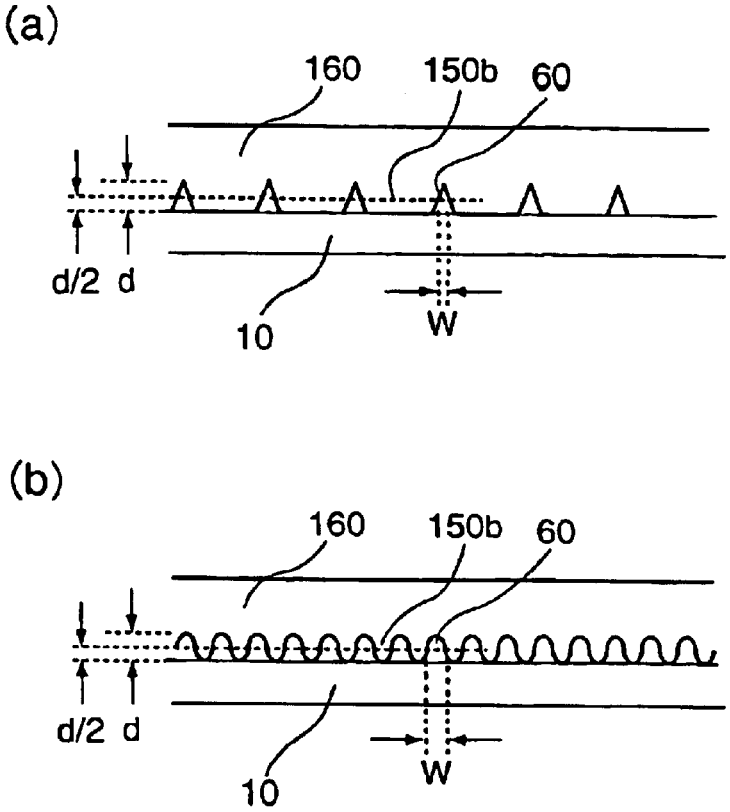
FIG. 23 is a drawing for describing the slit shapes different from the one shown in FIG. 22.

As seen from downstream in terms of the moving direction of the fixing film 10, the slits in this embodiment appear as shown in FIG. 22, with the flat bottom surface being perpendicular to the parallel flat side walls. However, they may be V-shaped in cross section as shown in FIG. 23*a*, or may be shaped so that the bottom surface of the film guiding member 16 appears wavy in cross section, as shown in FIG. 23*b*, as seen from downstream.

Further, the slits 60 in this embodiment are the parts of the stair-like portion 150*b* (FIG. 20), which is on the downstream side with respect to the fixing film sliding portion S. However, they may be the parts of the stair-like portion 150*a* (FIG. 20), which is on the upstream side. In other words, according to this embodiment, the bodies of grease on the portions of the inward surface of the fixing film 10, corresponding in position to the slits 66, are not scraped away. Therefore, it is possible to efficiently send grease into the fixing film sliding portion S.

Embodiment 8

This embodiment is similar to the above described Embodiment 7, except that the height h' of the stair-like portion 150*a* in this embodiment, which is on the upstream side with respect to the fixing film sliding portion S in terms of the moving direction of the fixing film 10, is less than that in Embodiment 7.

Figure 24:
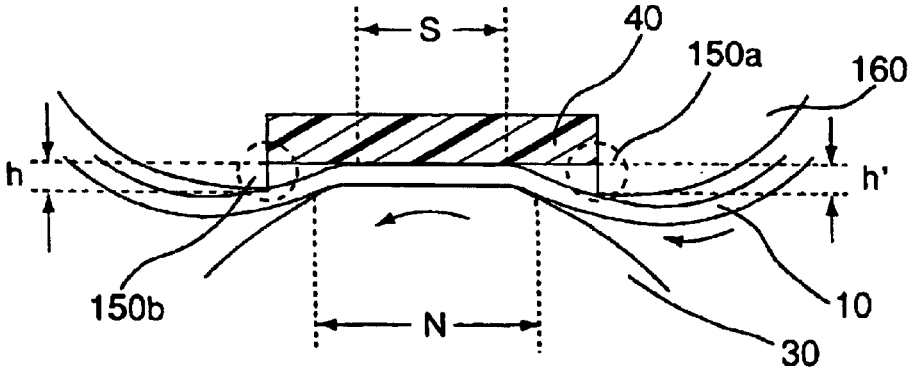
FIG. 24 is a schematic sectional view of the adjacencies of the fixing film sliding portion in the eighth embodiment of a fixing apparatus in accordance with the present invention.

FIG. 24 is a schematic sectional view of the adjacencies of the fixing film sliding portion S between the fixing film 10 and slippery member 40, in the fixing nip N, in this embodiment. The height h' of the stair-like portion 150*a*, which is on the upstream side with respect to the fixing film sliding portion S in terms of the moving direction of the fixing film 10, is not more than 0.2 mm from the fixing film sliding portion S. The upstream stair-like portion 150*a* does not affect the recording medium separation. Therefore, the upstream stair-like portion 150*a* does not need to be as high as the downstream stair-like portion 150*b*. The height h' of the stair-like portion 150*a* in this embodiment is 0.1 mm.

According to this embodiment, in order to reduce the amount by which grease collects in the space formed by the stair-like portion 150*a*, the outwardly facing surface of the slippery member 40, and fixing film 10, the height h' of the upstream stair-like portion 150*a* is reduced. Therefore, when grease viscosity is relatively high, for example, immediately after the power source of the main assembly is turned on, when the fixing apparatus has not sufficiently warmed up, the friction between the fixing film 10 and stair-like portion 150*a* is not as high as that in Embodiment 7.

Otherwise, the structure of this fixing apparatus 100 is the same as that of the seventh embodiment of a fixing apparatus 100. Therefore, it will not be described to avoid repetition of the same description.

Embodiment 9

This embodiment is similar to the above described Embodiment 7, except that the film guiding member 160 in this embodiment does not have the slippery member 40.

Figure 25:
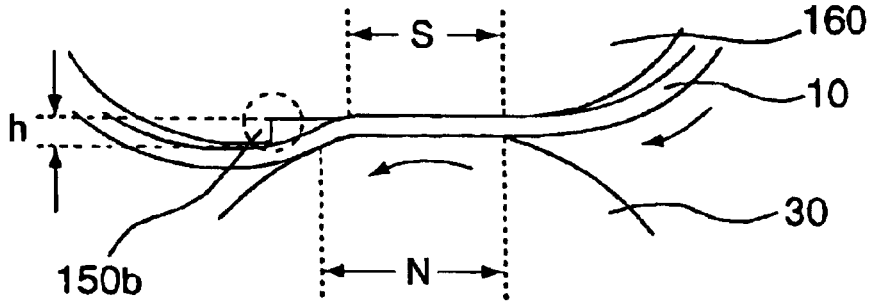
FIG. 25 is a schematic sectional view of the adjacencies of the fixing film sliding portion in the ninth embodiment of a fixing apparatus in accordance with the present invention.

FIG. 25 is a schematic sectional view of the interface between the fixing film 10 and film guiding member 160, and its adjacencies, in the fixing nip N in this embodiment. In this embodiment, the fixing film sliding portion S is the result of the direct contact between the downwardly facing surface of the film guiding member 160 and the inward surface of the fixing film 10; the fixing film slides directly on the downwardly facing surface of the film guiding member 160.

The material for the film guiding member 160 in this embodiment is desired to be superior in heat resistance. For example, heat resistant resin, such as phenol resin, polyimide resin, polyamide resin, polyamide-imide resin, polyether-ketone resin, polyester-sulfone resin, polyphenylene sulfide resin, LCP resin, etc., are recommendable. Further, the material for the film guiding member 160 in this embodiment is desired to be superior in slipperiness. Therefore, fluorinated resin such as PFA resin, PTFE resin, and FEP resin, or heat resistant resins containing a slippery substance, such as fluorinated resin, are recommendable as the materials for the film guiding member 160 in this embodiment.

This embodiment does not employ the slippery member 40. Therefore, it is lower in cost.

Further, the elimination of the slippery member 40 makes it possible to form the stair-like portion 150*b* as an integral part of the film guiding member 160, making therefore it possible to drastically reduce manufacturing errors regarding the height h of the stair-like portion 150*b*, compare to the structural arrangement in Embodiment 7, in which the stair-like portion 150*b* is created by the combination of the slippery member 40 and film guiding member 160.

Further, the film guiding member 160 in this embodiment is provided with only the stair-like portion 150*b*, or the downstream stair-like portion which contributes to the recording medium separation; the portion of the film guiding member 160 in the upstream adjacencies of the fixing film sliding portion S is not provided with a stair-like portion. With the employment of such a structural arrangement, it does not occur that the grease on the inward surface of the fixing film 10 is scraped away by a stair-like portion, on the upstream side with respect to the fixing film sliding portion S. In other words, the employment of such a structural arrangement makes it possible to further reduce the friction between the fixing film 10 and film guiding member 160.

As will be expected, in order to reduce the friction between the fixing film 10 and film guiding member 160, the downstream stair-like portion 150*b* is provided with a plurality of slits 160 similar to those in Embodiment 7 (FIG. 22).

Otherwise, the structure of this embodiment of a fixing apparatus 100 in accordance with the present invention is the same as that of the seventh embodiment of a fixing apparatus 100. Therefore, it will not be described to avoid the repetition of the same description.

Embodiment 10

The selection of the structure of the fixing apparatus 100 as an image heating apparatus does not need to be limited to those of the seventh to ninth embodiments of the present invention, in which the pressure roller driving method was employed.

Figure 26:
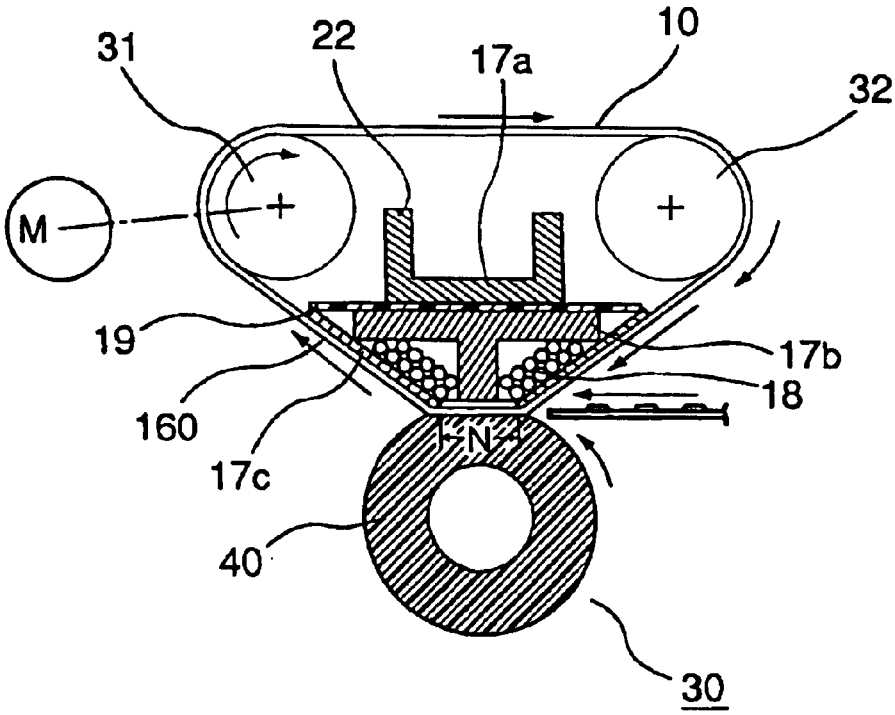
FIG. 26 is a schematic sectional view of the essential portions of the tenth embodiment of a fixing apparatus in accordance with the present invention.

For example, referring to FIG. 26, a fixing apparatus may comprise: a film guide 160, a driver roller 31, a tension roller 32, a pressure roller 30, and an endless fixing film 10, in which heat can be generated by electromagnetic induction. In this case, the fixing film 10 is stretched around the film guide 160, driver roller 31 and tension roller 32, being sandwiched by the bottom surface of the film guide 160 and the pressure roller 30 as a pressing member. The fixing nip N is formed by the film guide 160 and pressure roller 30, and the fixing film 10 is rotationally driven by the pressure roller 30. In this setup, the pressure roller 30 is rotated by the rotation of the fixing film 10.

On the inward side of the film guiding member 160, the combination of magnetic cores 17*a*, 17*b*, and 17*c*, and an exciting coil 18, is disposed as a magnetic field generating means.

The structures of the adjacencies of the fixing film sliding portion between the film guiding member 160 and fixing film 10 are similar to those in the seventh embodiment. That is, the film guiding member 160 has stair-like portions, and the stair-like portions have slits.

Miscellaneous Embodiments

1) In the case of the fixing film 10 in which heat can be generated by electromagnetic induction, and which is used for a thermal fixing apparatus for a monochromatic image forming apparatus, or a single-pass pass multicolor image forming apparatus, the elastic layer 2 of the fixing film 10 may be eliminated. The material for the heat generation layer 1 may be a mixture of resin and metallic filler. Further, the fixing film 10 may be a mono-layer film formed of a single substance in which heat can be generated by electromagnetic induction.

2) The fixing film 10 does not need to be an endless rotatable member. For example, it may be a id long roll of web, which can be repeatedly rolled out at one end while being rolled up at the other end.

3) The pressing member 30 does not need to be in the form of a roller; it may be in a form other than a roller. For example, it may be in the form of a rotatable belt. Further, the pressing member 30 may be provided with a heat generating means, for example, a heating means based on electromagnetic induction, for supplying heat to a recording member from the pressing member 30 as well as the fixing film 10, to keep the temperature of the fixing nip N at a predetermined level.

4) The application of the present invention regarding an image heating apparatus is not limited to a thermal image fixing apparatus such as the above described embodiments of the present invention. The present invention can be applied to a wide range of means and apparatuses for thermally processing an object to be heated, for example, an image heating apparatus for improving the surface properties, such as glossiness, of an image, by heating the recording medium bearing the image, an image heating apparatus for temporarily fixing an image, etc.

While the invention has been described with reference to the structures disclosed herein, it is not confined to the details set forth, and this application is intended to cover such modifications or changes as may come within the purposes of the improvements or the scope of the following claims.

What is claimed is:

1. An image heating apparatus for heating an image formed on a recording material, comprising:

a flexible movable member;

a supporting member, having a sliding surface for sliding relative to said movable member, for supporting said movable member;

a pressing member for forming a nip with said supporting member with said movable member therebetween;

wherein at least one of portions which are upstream and downstream of a portion of said supporting member forming the nip with respect to a movement direction of said movable member is provided with a projection which is projected toward said pressing member beyond the sliding surface, said projection being extended in a longitudinal direction of said supporting member, and wherein said supporting member is provided at a longitudinal end portion of the projection with a cut-away portion which is recessed, wherein a length Lf of said movable member measured in the longitudinal direction of said supporting member and a length of the projection Ld measured in the longitudinal direction, satisfy, Lf>Ld.

2. An apparatus according to claim 1, wherein the projection has a length measured in the longitudinal direction which is larger than a length of an image passing area of the nip.

3. An apparatus according to claim 1, wherein a surface roughness Ra of a surface of said movable member contactable to the sliding surface of said supporting member satisfies, $$0.07\mu \leqq Ra \leqq 0.5\mu.$$

4. An apparatus according to claim 1, wherein a surface of said movable member contactable to the sliding surface of said supporting member is provided with a groove extending in a direction of movement of said movable member.

5. An apparatus according to claim 1, wherein the cut-away portion is disposed at a position corresponding to a neighborhood of a peak of a pressure distribution in the longitudinal direction of the nip.

6. An apparatus according to claim 2, wherein a length Lf of said movable member measured in the longitudinal direction of said supporting member, a length of said supporting member Ls measured in the longitudinal direction, a length Lr of said pressing member measured in the longitudinal direction, a length of the projection Ld measured in the longitudinal direction, satisfy, $$Lf>Lr>Ld, \text{ and } Ls>Lr>Ld.$$

7. An apparatus according to claim 1, wherein the projection is disposed downstream of the sliding surface with respect to a movement direction of said movable member, and the height of the projection from said sliding surface is not less than 0.1 mm and not more than 1.0 mm.

8. An apparatus according to claim 1, wherein the projection is disposed upstream of the sliding surface with respect to a movement direction of said movable member, and the height of the projection from said sliding surface is not more than 0.2 mm.

9. An apparatus according to claim 1, wherein said supporting member has a second projection at a position outside the cut-away portion, said second projection being projected beyond the sliding surface toward said pressing member.

10. An apparatus according to claim 9, wherein the second projection has a height which is not less than 0.1 mm and not more than 1.0 mm.

11. An apparatus according to claim 1, wherein said supporting member has a sliding member at a position where said nip is formed, and said sliding member having a high sliding property, and said movable member slides on said sliding member.

12. An apparatus according to claim 1, wherein said movable member is a rotatable member.

13. An apparatus according to claim 1, further comprising magnetic field generating means, wherein said movable member has an electroconductive layer, and wherein eddy currents are generated in said electroconductive layer by the magnetic field, by which heat is generated in said movable member, and the heat heats the image on the recording material.

14. An apparatus according to claim 1, wherein further comprising a heater which generates heat upon electric energy supply thereto, wherein the image on the recording material is heated by the heat from said heater through said movable member.

15. An apparatus according to claim 1, wherein said pressing member is a rotatable member, and said movable member is driven by said rotatable member.

16. An image heating apparatus for heating an image formed on a recording material, comprising:

a flexible movable member;

a supporting member, having a sliding surface for sliding relative to said movable member, for supporting said movable member;

a pressing member for forming a nip with said supporting member with said movable member therebetween;

wherein each of portions which are upstream and downstream of a portion of said supporting member forming the nip with respect to a movement direction of said movable member is provided with a projection which is projected toward said pressing member beyond the sliding surface, said projection being extended in a longitudinal direction of said supporting member, and wherein said projection of said supporting member is provided with at least one slit, and the height of the upstream side projection from said sliding surface is not more than 0.2 mm.

17. An apparatus according to claim 16, wherein the slit extends in a direction substantially parallel with a movement direction of said movable member.

18. An apparatus according to claim 16, wherein the slit has a width which is not less than 0.5 and not more than 5 mm.

19. An apparatus according to claim 16, wherein the projection is disposed downstream of the sliding surface with respect to a movement direction of said movable member, and the height of the projection from said sliding surface is not less than 0.1 mm and not more than 1.0 mm.

20. An apparatus according to claim 16, wherein said supporting member has a sliding member at a position where said nip is formed, and said sliding member having a high sliding property, and said movable member slides on said sliding member.

21. An apparatus according to claim 16, wherein said movable member is a rotatable member.

22. An apparatus according to claim 16, further comprising magnetic field generating means, wherein said movable member has an electroconductive layer, and wherein eddy currents are generated in said electroconductive layer by the magnetic field, by which heat is generated in said movable member, and the heat heats the image on the recording material.

23. An apparatus according to claim 16, wherein further comprising a heater which generates heat upon electric energy supply thereto, wherein the image on the recording material is heated by the heat from said heater through said movable member.

24. An apparatus according to claim 16 wherein said pressing member is driven by said rotatable member.

* * * * *

UNITED STATES PATENT AND TRADEMARK OFFICE

CERTIFICATE OF CORRECTION

PATENT NO. : 6,947,699 B2
DATED : September 20, 2005
INVENTOR(S) : Masahiro Suzuki et al.

It is certified that error appears in the above-identified patent and that said Letters Patent is hereby corrected as shown below:

Title page,
Item [30], Foreign Application Priority Data,
"2002/027970" should read -- 2002-027970 --; and
"2002/087772" should read -- 2002-087772 --.
Item [56], References Cited, FOREIGN PATENT DOCUMENTS,
"10198200 A * 7/1998" should read
-- 10-198200 A * 7/1998 --.

Column 1,
Line 14, "contacts" should read -- contacts a --.
Line 40, "file" should read -- film --.

Column 3,
Line 32, "flexible" should read -- a flexible --.
Line 33, "supporting" should read -- a supporting --.

Column 4,
Line 28, "beat" should read -- heat --.

Column 10,
Line 27, "an" should read -- with an --.

Column 11,
Line 67, "in this" should read -- is in this --.

Column 14,
Line 31, "respective" should read -- respect --.
Line 48, "allow" should read -- allowed --.

Column 18,
Line 9, "therefore it" should read -- it therefore --.

Column 19,
Line 37, "mM. If this" should read -- mm. If this --.
Line 50, "0.3 mm." should read -- 0.3 mm. --.

Column 20,
Line 33, "break" should read -- broken --.

UNITED STATES PATENT AND TRADEMARK OFFICE

CERTIFICATE OF CORRECTION

PATENT NO. : 6,947,699 B2
DATED : September 20, 2005
INVENTOR(S) : Masahiro Suzuki et al.

It is certified that error appears in the above-identified patent and that said Letters Patent is hereby corrected as shown below:

Column 21,
Line 52, “therefore it” should read -- it therefore --.
Line 54, “compare” should read -- compared --.

Column 22,
Line 57, “be a id” should read -- be a --.

Column 23,
Line 67, “longi” should read -- longi- --.

Column 24,
Line 37, “wherein” should be deleted.

Column 26,
Line 7, “wherein” should be deleted.
Line 12, “claim 16” should read -- claim 16, --.

Signed and Sealed this

Fourteenth Day of February, 2006

JON W. DUDAS
*Director of the United States Patent and Trademark Office*